US011841033B2

(12) United States Patent
Takano

(10) Patent No.: US 11,841,033 B2
(45) Date of Patent: Dec. 12, 2023

(54) ELECTRIC POWERED WORK MACHINE AND METHOD OF CONTROLLING NOISE GENERATED BY ELECTRIC POWERED WORK MACHINE

(71) Applicant: MAKITA CORPORATION, Anjo (JP)

(72) Inventor: Hideaki Takano, Anjo (JP)

(73) Assignee: MAKITA CORPORATION, Anjo (JP)

( * ) Notice: Subject to any disclaimer, the term of this patent is extended or adjusted under 35 U.S.C. 154(b) by 131 days.

(21) Appl. No.: 17/583,354

(22) Filed: Jan. 25, 2022

(65) Prior Publication Data

US 2022/0235798 A1 Jul. 28, 2022

(30) Foreign Application Priority Data

Jan. 27, 2021 (JP) ..... 2021-011309

(51) Int. Cl.

| | |
|---|---|
| ***F04D 29/66*** | (2006.01) |
| ***F04D 25/06*** | (2006.01) |
| ***G10K 11/178*** | (2006.01) |
| ***A47L 9/10*** | (2006.01) |
| ***A47L 5/36*** | (2006.01) |

(52) U.S. Cl.

CPC ..... *F04D 29/661* (2013.01); *A47L 5/365* (2013.01); *A47L 9/102* (2013.01); *F04D 25/06* (2013.01); *G10K 11/1785* (2018.01); *G10K 2210/3028* (2013.01)

(58) Field of Classification Search

CPC ..... G10K 11/1785; G10K 2210/3028; F04D 29/661; F04D 25/06; A47L 5/365; A47L 9/102

See application file for complete search history.

(56) References Cited

U.S. PATENT DOCUMENTS

2010/0266134 A1* 10/2010 Wertz ..... G10K 11/17879 381/71.1
2019/0270350 A1* 9/2019 Bastyr ..... G10K 11/1785

FOREIGN PATENT DOCUMENTS

| | | | | |
|---|---|---|---|---|
| EP | 2242044 | A2 * | 10/2010 | ..... G10K 11/178 |
| EP | 3678129 | A1 * | 7/2020 | ..... G10K 11/17821 |
| JP | H06-508695 | A | 9/1994 | |
| WO | 93/02445 | A1 | 2/1993 | |
| WO | WO-2005027338 | A2 * | 3/2005 | ..... G10K 11/178 |

* cited by examiner

*Primary Examiner* — David L Ton
(74) *Attorney, Agent, or Firm* — Oliff PLC

(57) ABSTRACT

An electric powered work machine according to one aspect of the present disclosure includes a first and a second digital filters, a control sound source, an error sensor, and a characteristics adjustor. The first digital filter includes a series of taps and generates a control signal. The control sound source produces an artificial noise in accordance with the control signal. The error sensor converts a synthesized sound of the artificial noise and a target noise at a canceling location to an error signal. The second digital filter includes N taps and generates a filtered reference signal. The characteristics adjustor uses the error signal and the filtered reference signal to adjust a coefficient of each tap of M taps in the series of taps. Each of M and N is a positive integer satisfying M<N.

20 Claims, 25 Drawing Sheets

ELECTRIC POWERED WORK MACHINE AND METHOD OF CONTROLLING NOISE GENERATED BY ELECTRIC POWERED WORK MACHINE

CROSS-REFERENCE TO RELATED APPLICATIONS

This application claims the benefit of Japanese Patent Application No. 2021-011309 filed on Jan. 27, 2021 with the Japan Patent Office, the entire disclosure of which is incorporated herein by reference.

BACKGROUND

The present disclosure relates to noise control in an electric powered work machine.

Japanese Patent Application Publication No. H6-508695 discloses active noise control (ANC) being applied to noise reduction of electric powered work machines.

ANC is a technique to cancel a noise, which is generated from a noise source, with a control sound. The noise is measured by a first microphone. The control sound is emitted from a speaker. The control sound is produced based on the noise measured by the first microphone. The control sound is produced at a location where the noise needs to be canceled (hereinafter simply referred to as "canceling location"), having an inverted phase of the noise. The control sound is produced by an adaptive filter. Characteristics of the adaptive filter are sequentially calculated in accordance with, for example, an adaptive algorithm. Examples of the adaptive algorithm may include Filtered-X algorithm or Normalized Least Mean Square (NLMS) algorithm.

In addition to the adaptive filter, ANC uses a second order system filter. In the second order system filter, characteristics of a second order system are modeled. The second order system corresponds to a path from a speaker to a second microphone that detects an error. The adaptive filter and the second order system filter are digital filters. Each of these digital filters has a certain number of taps (for example, in a range of several hundreds of taps) based on the length of time necessary for its impulse response to sufficiently converge.

SUMMARY

It is difficult to use ANC without a computer with a high computing processing capability. Adaptive algorithm calculations require an enormous amount of processing. The calculations need to be completed within a period sufficiently shorter than the time for the noise detected by the first microphone to propagate and arrive at the canceling location.

It is desirable that one aspect of the present disclosure provides a technique to reduce the amount of computing processing necessary for reducing a noise of an electric powered work machines.

An electric powered work machine according to one aspect of the present disclosure includes a motor. The motor generates a driving force necessary for performing a jobsite work. Examples of the jobsite work includes work at do-it-yourself carpentry, manufacturing, gardening, and construction sites.

The electric powered work machine includes a reference acquirer. The reference acquirer acquires a reference signal.

The reference signal has a correlation with a target noise. The target noise corresponds to a noise generated due to operation of the motor.

The electric powered work machine includes a first digital filter (or noise control filter). The first digital filter includes a series of taps. Each tap of the series of taps has an adjustable coefficient. The first digital filter is configured to (i) receive the reference signal from the reference acquirer and (ii) generate a control signal to cancel or attenuate the target noise.

The electric powered work machine includes a control sound source (or control source, or secondary source, or secondary sound source, or control loudspeaker, or secondary loudspeaker). The control sound source produces an artificial noise (or canceling sound, or attenuating sound, or secondary sound, or canceling acoustic signal, or attenuating acoustic signal, or secondary signal) in accordance with the control signal.

The electric powered work machine includes an error sensor. The error sensor converts a synthesized sound at a given canceling location (or a given attenuating location) to an error signal. The synthesized sound corresponds to a combined sound of the artificial noise and the target noise at the canceling location. The error sensor may be configured to detect (or acquire) the synthesized sound. The error signal may digitally indicate the synthesized sound detected by the error sensor.

The electric powered work machine includes a second digital filter (or second order system filter). The second digital filter includes transfer characteristics of a second order system. The second order system corresponds to a path from the control sound source to the error sensor. In other words, in the second digital filter, the second order system is modeled. That is, the second digital filter includes transfer characteristics that are the same as (or almost the same as, or similar to) actual transfer characteristics (or a response) of the second order system. The second digital filter includes N taps. The second digital filter (i) receives the reference signal from the reference acquirer and (ii) generates a filtered reference signal.

The electric powered work machine includes a characteristics adjustor. The characteristics adjustor adjusts (or updates) the adjustable coefficient of each tap of M taps in the series of taps in accordance with an adaptive algorithm. The adaptive algorithm uses the error signal and the filtered reference signal. The M taps may be any number of taps in the series of taps. Each of M and N is a positive integer satisfying $M<N$. The any number of taps may include all taps in the series of taps.

Such a configuration can reduce the number of taps of the first digital filter, while inhibiting divergence of the first digital filter. As a result, it is possible to reduce the amount of the computing processing for the adaptive algorithm.

M taps may correspond to all taps of the series of taps. The characteristics adjustor may update the adjustable coefficient for all taps of the M taps.

The electric powered work machine may include a divergence determiner. The divergence determiner may determine whether the first digital filter indicates a divergence tendency. The characteristics adjustor may update the adjustable coefficient of each tap of L taps in the series of taps prior to a determination, by the divergence determiner, that the first digital filter indicates a divergence tendency. The characteristics adjustor may set the adjustable coefficient of each tap of an $M+1^{th}$ tap and subsequent taps in the series of taps to a given value and update the adjustable coefficient of each tap of $1^{st}$ to $M^{th}$ taps in the series of taps, in response to a determination, by the divergence determiner, that the first digital filter indicates a divergence tendency. L taps may correspond to all taps of the series of taps. L may be a positive integer satisfying L≥N.

The given value may be a coefficient of a corresponding tap in an imaginary digital filter. The imaginary digital filter may include characteristics obtained by multiplying an impulse response of a first order system by characteristics of a reverse filter of the second order system filter. The first order system corresponds to a path from the motor to the error sensor. Multiplying the impulse response of the first order system by the characteristics of the reverse filter of the second order system filter is, in other words, dividing the impulse response of the first order system by the characteristics of the second digital filter. The reverse filter of the second digital filter may be reverse characteristics of an impulse response of the second order system (specifically, a sound propagation path from the control sound source to the error sensor). That is, the imaginary digital filter may include characteristics obtained by dividing the impulse response of the first order system by the impulse response of the second order system.

The divergence determiner may determine whether the first digital filter indicates a divergence tendency based on an intensity of the error signal and/or a change tendency in the intensity.

The divergence determiner may determine whether the first digital filter indicates a divergence tendency based on an output intensity of each tap of the L taps, a magnitude of the adjustable coefficient of each tap of the L taps, and/or a change tendency in a parameter used for updating the adjustable coefficient.

The L taps may have a length that corresponds to a length of time necessary for the impulse response of the first order system to converge.

N taps may have a length (or a total number of taps) to complete a process necessary for producing the artificial noise. The process necessary for producing the artificial noise may include a first process. The first process is executed by the characteristics adjustor. The first process includes updating of the adjustable coefficient by the characteristics adjustor in accordance with the reference signal within a first time period. The first time period corresponds to a time required from an acquisition of the reference signal by the reference acquirer to a detection of the target noise corresponding to the reference signal by the error sensor. The process necessary for producing the artificial noise may include a second process. The second process is executed by the first digital filter. The second process includes generation of the control signal in accordance with the reference signal by the first digital filter with the adjustable coefficient updated by the first process.

The characteristics adjustor may stop updating of the adjustable coefficient in response to the adjustable coefficient being updated a given number of times by the characteristics adjustor (or the number of updating of the adjustable coefficient by the characteristics adjustor reaching a threshold). The given number of times may include one time.

The characteristics adjustor may update the adjustable coefficient based on an update value. The update value corresponds to a value obtained by multiplying an update step size by a gradient vector. The update step size indicates a degree to which the adjustable coefficient is varied. The gradient vector indicating a direction toward which the adjustable coefficient is varied.

The characteristics adjustor may calculate the update value with an average value of the gradient vector that is repeatedly calculated every two or more processing cycles.

Such a configuration makes it possible to inhibit the updating of the adjustable coefficient of the first digital filter from being affected by a sudden variation in an external environment.

The characteristics adjustor may change the update step size in accordance with a converging status of the first digital filter.

Such a configuration makes it possible to further reduce divergence of the first digital filter.

The reference acquirer may include a reference sensor. The reference sensor detects the target noise to thereby generate the reference signal.

A distance between the reference sensor and the control sound source may be larger than a distance between the control sound source and the error sensor.

The electric powered work machine may generate a drive signal for driving the motor. The reference signal may correspond to the drive signal.

The reference acquirer may include a third digital filter. The third digital filter includes characteristics identical to characteristics of the second digital filter. The third digital filter being (i) receives the control signal from the first digital filter and (ii) generates an arrival signal. The arrival signal indicates the artificial noise that has arrived at the error sensor.

The reference acquirer may include an adder. The adder adds the arrival signal to the error signal to generate the reference signal.

The electric powered work machine may include a fan. The fan is driven by the motor to generate an airflow. The electric powered work machine may include a flow path. The flow path allows passage of the airflow generated by the fan. The electric powered work machine may include a discharge port. The discharge port discharges the airflow from the flow path. The control sound source and the error sensor may be arranged such that the discharge port corresponds to the canceling location.

The flow path may include an inner wall configured to guide the airflow. At least a part of the inner wall may include a sound absorbing material. The sound absorbing material reduces a sound generated due to a friction between the sound absorbing material and the airflow. The error sensor may be disposed at a position so that the error sensor faces the flow path with the sound absorbing material interposed therebetween.

Such a configuration makes it possible to inhibit a noise except the target noise from being detected by the error sensor. This makes it possible to improve an accuracy in reducing the target noise with the artificial noise.

Another aspect of the present disclosure provides a method of controlling a noise generated by an electric powered work machine. The method includes acquiring a reference signal. The reference signal has a correlation with a target noise. The target noise corresponds to a noise generated due to operation of the motor in the electric powered work machine. The method includes generating a control signal from the reference signal by a first digital filter. The control signal is used to cancel or attenuate the target noise. The first digital filter includes a series of taps. The first digital filter includes adjustable characteristics. The method includes producing an artificial noise by a control sound source in accordance with the control signal. The method includes converting a synthesized sound at a canceling location (or an attenuating location) to an error signal by an error sensor. The canceling location is a given position. The synthesized sound corresponds to a combined sound of the artificial noise and the target noise. The method includes generating a filtered reference signal from the reference signal by a second digital filter. The second digital filter includes transfer characteristics of a second order system. The second order system corresponds to a path from the control sound source to the error sensor. In other words, in the second digital filter, the second order system is modeled. The second digital filter includes N taps. The method includes updating coefficients of M taps in the series of taps in accordance with an adaptive algorithm. The adaptive algorithm uses the error signal and the filtered reference signal. The M taps may be any number of taps in the series of taps. Each of M and N is a positive integer satisfying M<N.

Such a method may achieve the same effects as the effects achieved by the above-described electric powered work machine.

BRIEF DESCRIPTION OF THE DRAWINGS

Example embodiments of the present disclosure will be described hereinafter by way of example with reference to the accompanying drawings, in which.

DETAILED DESCRIPTION OF EXEMPLARY EMBODIMENTS

1. First Embodiment

[1-1. Configuration of Dust Collector]

Figure 1:
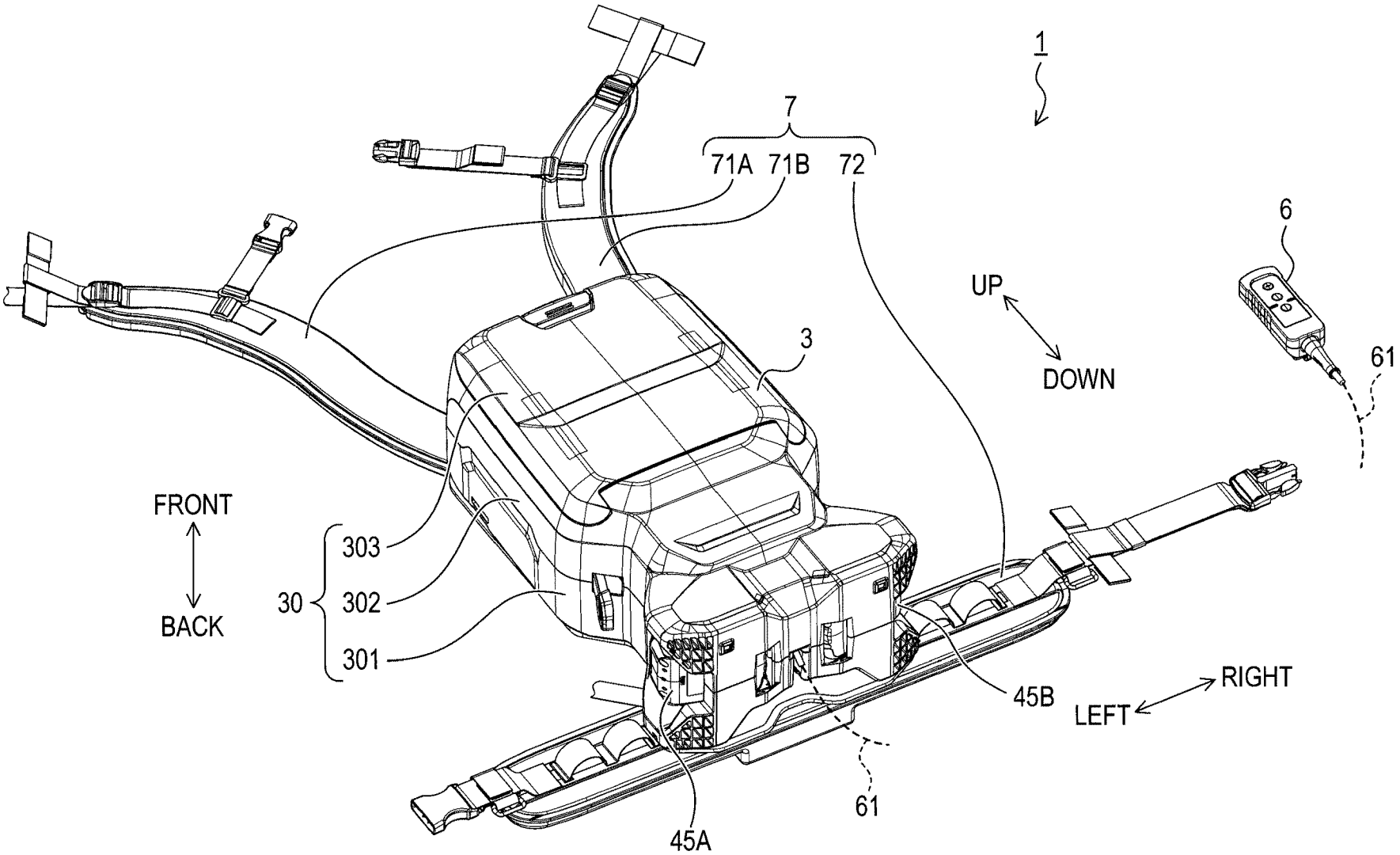
FIG. 1 is a perspective view of the appearance of a dust collector according to a first to a third embodiment.
Figure 2:
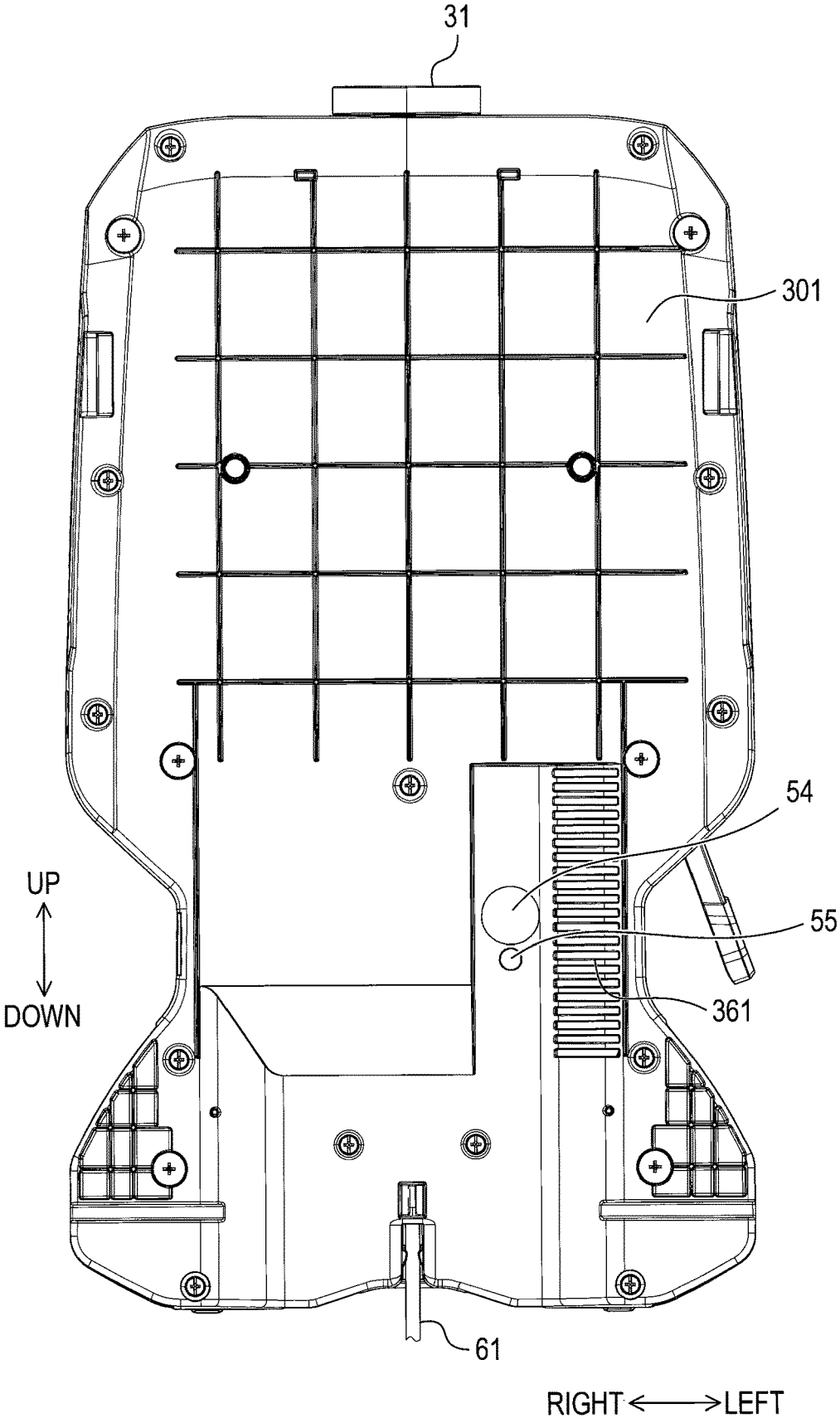
FIG. 2 is a bottom view of a dust collector main body.

A dust collector 1, which is one example of the electric powered work machine, will be described. The dust collector 1 is used in a state carried by an operator of the dust collector 1 on his or her back. For convenience of description, the direction (front, back, up, down, left, and right) with respect to the dust collector 1 is defined as illustrated in FIGS. 1 to 7 in the first embodiment.

As illustrated in FIGS. 1 to 7, the dust collector 1 includes a main body 3, an operation device 6, and attachments 7.

The attachments 7 include a first shoulder strap 71A, a second shoulder strap 71B, and a waist belt 72. The first and second shoulder belts 71A, 71B and the waist belt 72 are attached to the back surface of the main body 3. The first shoulder strap 71A extends from the upper left end of the main body 3. The second shoulder strap 71B extends from the upper right end of the main body 3. The first shoulder strap 71A is worn over the left shoulder of the operator. The second shoulder strap 71B is worn over the right shoulder of the operator. The waist belt 72 extends from near the bottom end of the main body 3. The waist belt 72 is fastened around the waist of the operator. The main body 3 is suspended from the back of the operator by means of the attachments 7.

The operation device 6 includes a switch to actuate or stop the dust collector 1. The operation device 6 is manipulated by the operator. The operation device 6 is connected, via a cable 61, to the main body 3 near the center of the bottom end of the main body 3.

The main body 3 includes a housing 30.

The housing 30 includes a lower housing 301, an upper housing 302, and a plate 303. The lower housing 301 has an opening on its front surface. The lower housing 301 is shaped like a box with a bottom. The upper housing 302 has an opening on its front surface and back surface. The upper housing 302 is shaped like a frame. The plate 303 covers the opening on the upper side of the upper housing 302. The plate 303 is plate-shaped. The housing 30 may be, for example, molded by injecting a resin material.

The housing 30 includes a suction port 31, a dust collecting chamber 32, a first flow path 33, a motor chamber 34, a second flow path 35, an exhaust chamber 36, a first battery compartment 37A, a second battery compartment 37B, and a component placement portion 38.

The suction port 31 is provided in the central portion of the top end of the housing 30. The suction port 31 is connected to a first end of a flexible hose (not illustrated). A second end of the hose is connected to a nozzle having a suction port.

The dust collecting chamber 32 is a space provided on the upper side of the interior of the housing 30, and has a rectangular shape. The dust collecting chamber 32 stores a dust bag 41 that is connected to the suction port 31. The dust bag 41 is made of, for example, paper. The dust bag 41 traps and collects grit and dust sucked from the suction port 31.

The first flow path 33 is provided along the right side of the dust collecting chamber 32. The bottom end of the first flow path 33 is connected to the motor chamber 34. In the housing 30, a filter 42 is arranged at the border between the first flow path 33 and the dust collecting chamber 32. Examples of the filter 42 may include a high efficiency particulate air filter (HEPA).

The motor chamber 34 is a rectangular shaped space provided inside the housing 30 below the dust collecting chamber 32. The motor chamber 34 includes an inlet port 341 provided in the central portion of the right end of the motor chamber 34. The inlet port 341 is connected to the first flow path 33. The motor chamber 34 includes an outlet port 342 provided in the upper portion of the left end of the motor chamber 34. The outlet port 342 is connected to the second flow path 35. The motor chamber 34 houses a drive unit (or drive system) 43.

Figure 3:
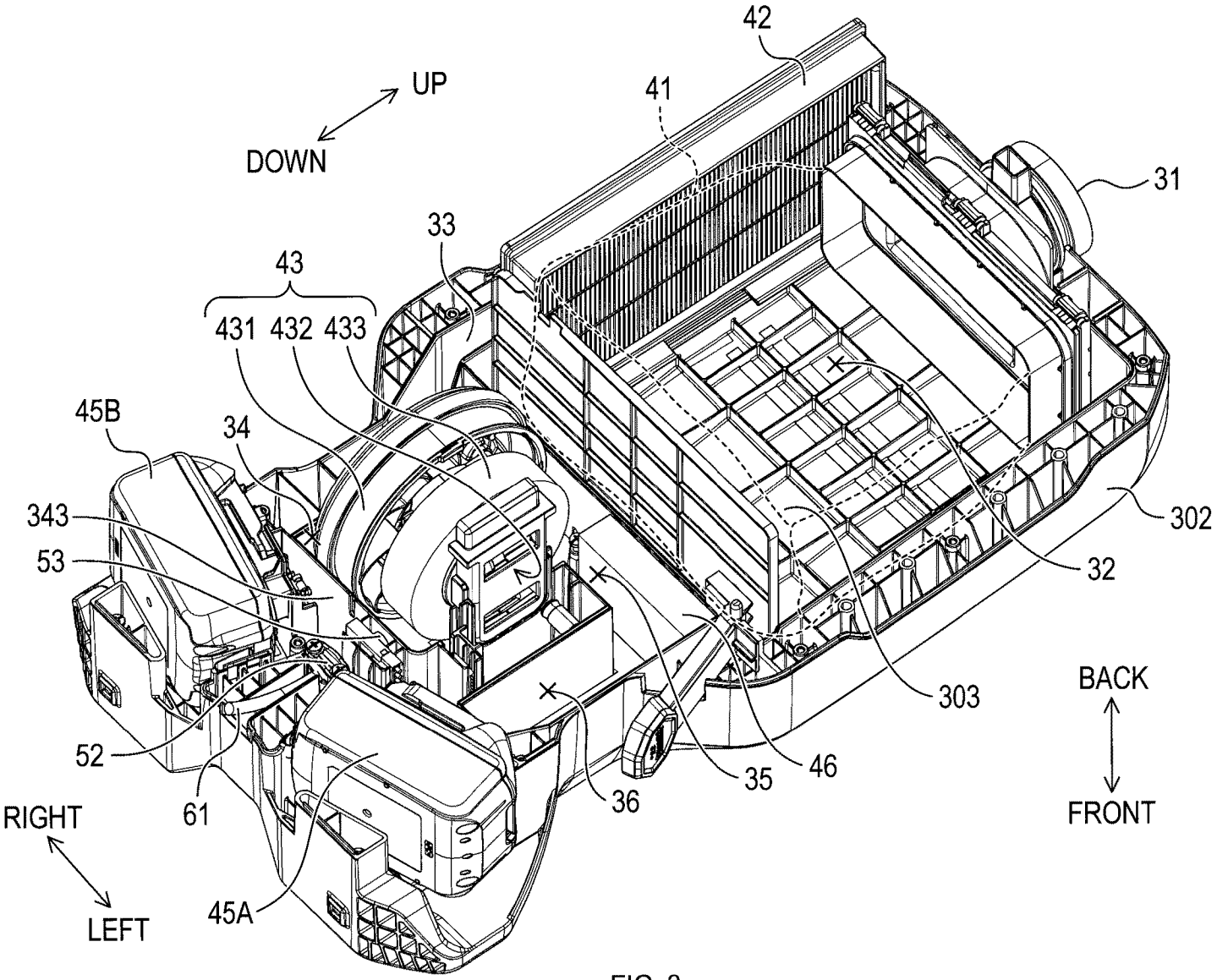
FIG. 3 is a perspective view of an internal state of the dust collector main body with a lower housing removed.
Figure 4:
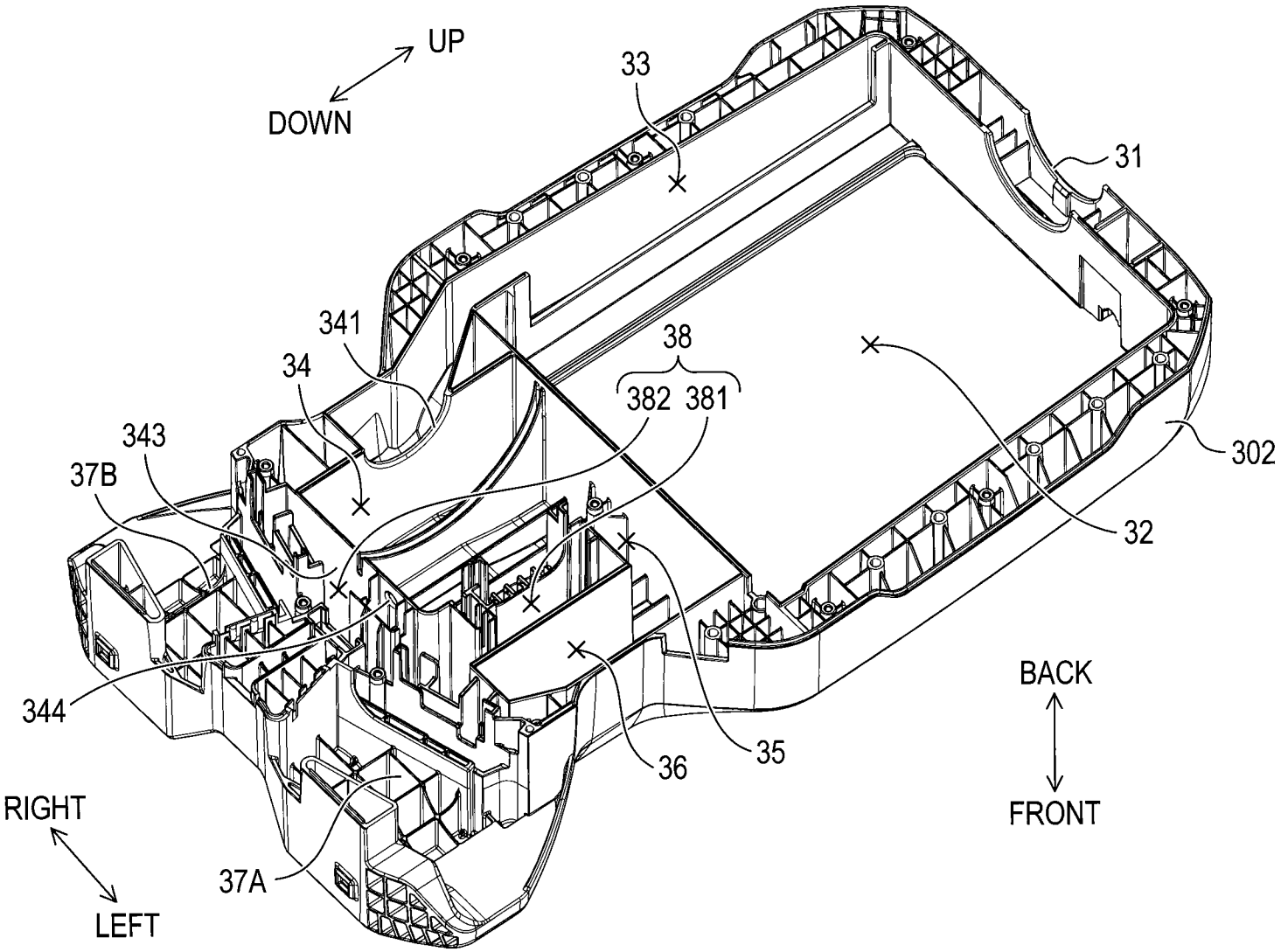
FIG. 4 is a perspective view of an upper housing without components installed therein, the upper housing being viewed from a side where a joining surface connecting the upper housing with the lower housing is provided.
Figure 5:
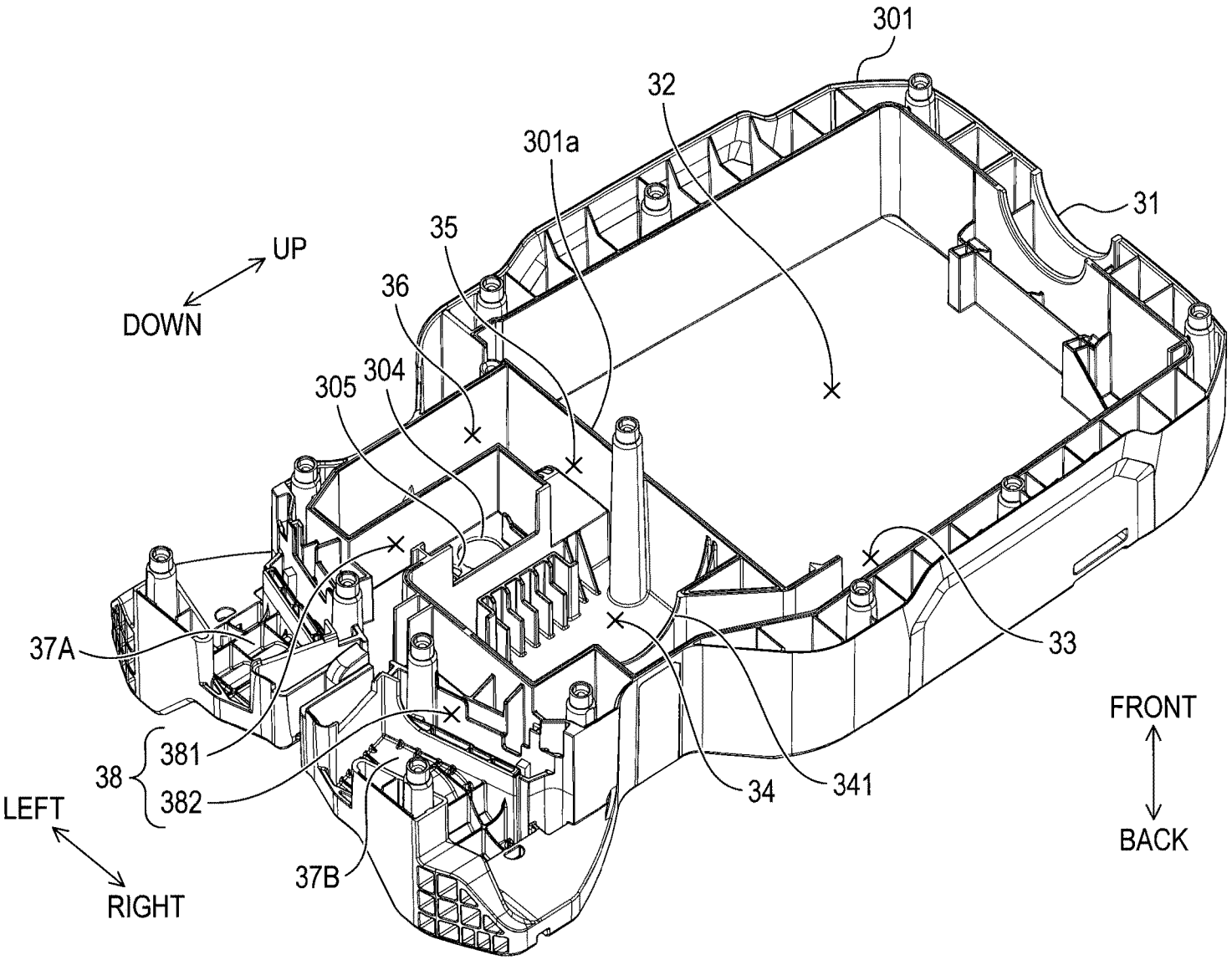
FIG. 5 is a perspective view of the lower housing without components installed therein, the lower housing being viewed from the side where the joining surface is provided.
Figure 6:
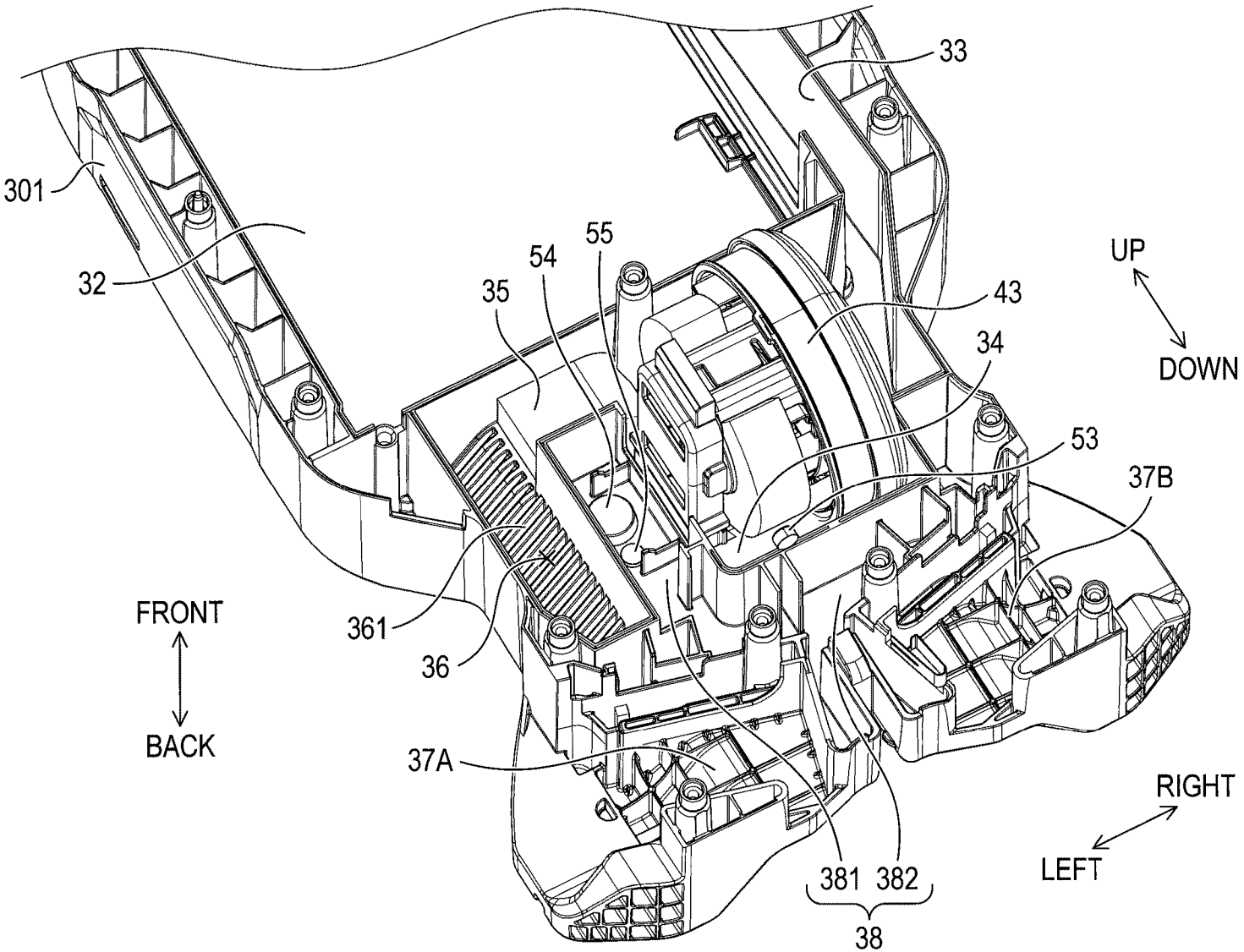
FIG. 6 is a perspective view of a state of the lower housing with some components installed therein.

The drive unit 43 includes a fan 431, a motor 432, and a damper 433. The fan 431 is connected to the rotor of the motor 432. The fan 431 is driven by the motor 432 to generate an airflow. The airflow travels from the inlet port 341 into the motor chamber 34, and then flows out from the outlet port 342. The damper 433 has an annular shape, covering the circumference of the motor 432. The damper 433 absorbs a noise generated by the motor 432. The damper 433 may be a sponge, for example. In the first embodiment, the motor 432 is covered with the damper 433, thereby not being illustrated in FIGS. 3 and 6. In FIGS. 3 and 6, the motor 432 is arranged in the center of the damper 433.

The second flow path 35 connects the outlet port 342 with the exhaust chamber 36. The second flow path 35 has a sound absorbing material 46 arranged therein. The lower housing 301 includes a first wall 301*a* that separates the second flow path 35 and the dust collecting chamber 32. The sound absorbing material 46 is provided on the first wall 301*a*. The sound absorbing material 46 may be a sponge.

The exhaust chamber 36 is a space provided inside of the housing 30 on the left side of the motor chamber 34. The exhaust chamber 36 includes a discharge port 361 provided on the bottom surface of the housing 30. The discharge port 361 has the shape of slits.

In the main body 3 configured as described above, when the drive unit 43 generates airflow, external air is introduced through the suction port 31 (specifically, through a hose, a nozzle, or other attachment(s) connected to the suction port 31) to the inside of the housing 30. The introduced external air reaches the dust collecting chamber 32 and passes through the dust bag 41. The passage of the external air through the dust bag 41 leaves grit and dust contained in the external air trapped and collected inside the dust bag 41. The air that passes through the dust bag 41 flows through the filter 42, then reaching the first flow path 33. The filter 42 traps and collects finer grit and dust that cannot be caught by the dust bag 41. The air that reaches the first flow path 33 passes through the motor chamber 34 and the second flow path 35, then reaching the exhaust chamber 36. The air that reaches the exhaust chamber 36 flows through the discharge port 361, being discharged to the outside of the housing 30.

The first battery compartment 37A houses a first battery pack 45A. The first battery compartment 37A is provided in the vicinity of the bottom end of the housing 30. The first battery compartment 37A includes a first battery mounting hole 371A that is open at around the lower left end of the housing 30. The second battery compartment 37B houses a second battery pack 45B. The second battery compartment 37B is disposed in the vicinity of the bottom end of the housing 30. The second battery compartment 37B includes a second battery mounting hole 371B that is open at around the lower right end of the housing 30. The first and second battery packs 45A, 45B are respectively inserted from the first and second battery mounting holes 371A, 371B to the first and second battery compartments 37A, 37B. Examples of each of the first and second battery packs 45A, 45B include a general-purpose battery. Each of the first and second battery packs 45A, 45B can be used for a power source of an electric powered work machine of various types.

The component placement portion 38 is a space in the housing 30 between an air flowing area and a battery area. The air flowing area includes the motor chamber 34, the second flow path 35, and the exhaust chamber 36. The battery area includes the first and second battery compartments 37A, 37B. In the component placement portion 38, various electrical components are arranged. The component placement portion 38 includes a first area 381 and a second area 382. The first area 381 is surrounded on its three sides by the motor chamber 34, the second flow path 35, and the discharge port 361. The second area 382 is interposed between the motor chamber 34 and the first and second battery compartments 37A, 37B. The second area 382 communicates with the first area 381.

In the second area 382, a connector 52 and a reference microphone 53 are provided.

The connector 52 is arranged between the first and second battery compartments 37A, 37B. The connector 52 connects the cable 61 to a circuit in the main body 3.

The reference microphone 53 is mounted using a first mounting hole 344. The first mounting hole 344 is formed on a second wall 343 that defines a boundary of the motor chamber 34. The reference microphone 53 is mounted such that the reference microphone 53 is directional toward the inside of the motor chamber 34. The reference microphone 53 detects a target noise generated inside the housing 30. Specifically, the target noise includes a noise generated by the motor 432 and the fan 431, and a noise generated by airflow produced by the drive unit 43. The reference microphone 53 outputs a first detection signal indicating the target noise detected.

Figure 7:
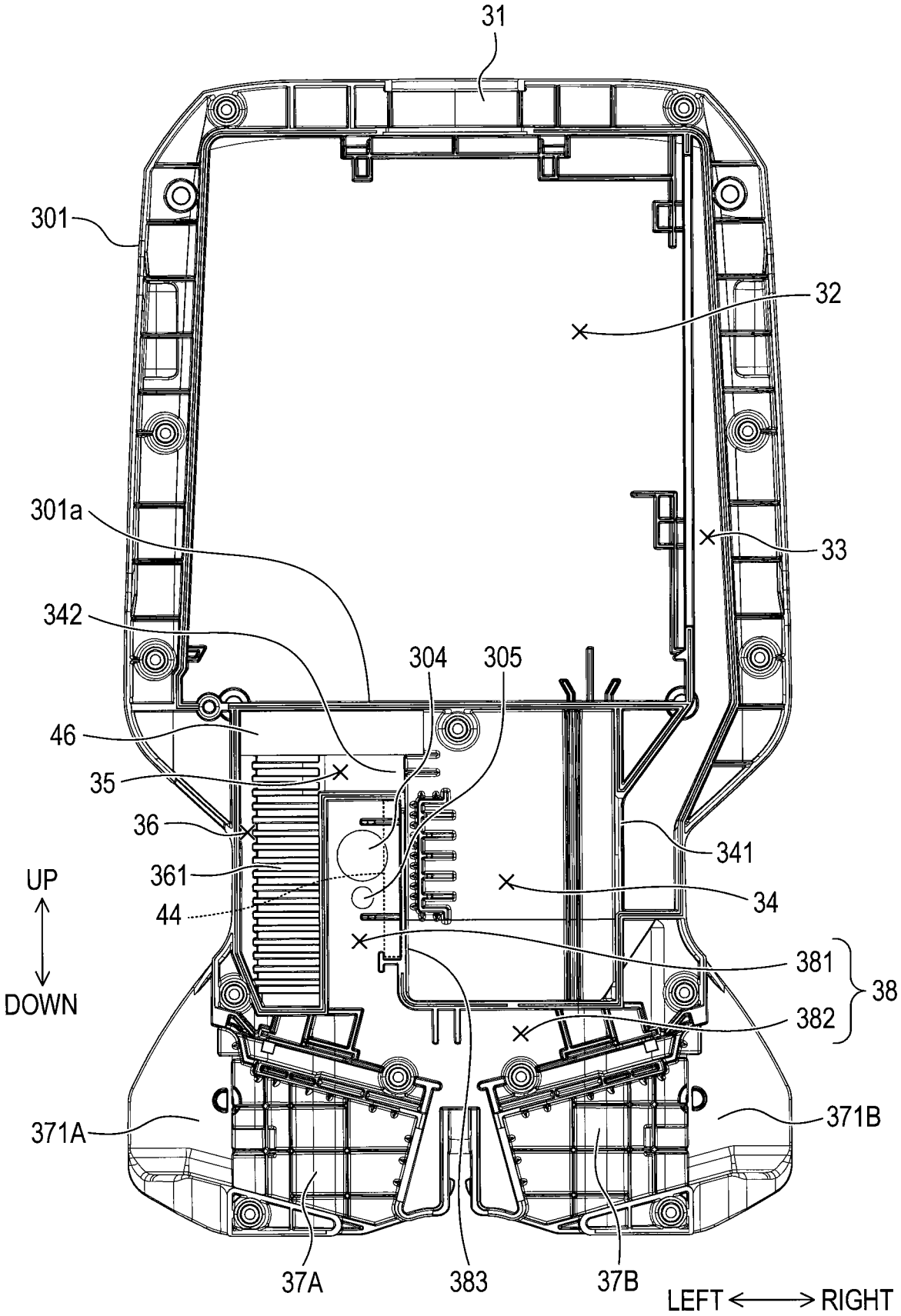
FIG. 7 is a plan view of the lower housing.

In the first area 381, a control speaker (or control sound source, or control loudspeaker, or secondary loudspeaker, or secondary source, or secondary sound source) 54, an error microphone 55, and a drive controller 44 are provided. The control speaker 54 and the error microphone 55 are mounted respectively using a second mounting hole 304 and a third mounting hole 305. The second mounting hole 304 and the third mounting hole 305 are formed on the bottom surface of the lower housing 301. The control speaker 54 and the error microphone 55 are mounted such that the control speaker 54 and the error microphone 55 are directional toward the outside of the housing 30. As illustrated in FIG. 7, the drive controller 44 is attached to a third wall 383 that defines a boundary between the first area 381 and the motor chamber 34. The drive controller 44 includes a circuit board having circuit(s) that perform power supply control, motor control, noise control, and so on. Details of the drive controller 44 will be described later.

The error microphone 55 is provided in the vicinity of a canceling location (or an attenuating location). The canceling location corresponds to a position where the target noise needs to be canceled or attenuated by a sound produced (or emitted) from the control speaker 54 (hereinafter referred to as "artificial noise"). Examples of the canceling location may include the discharge port 361. The error microphone 55 is situated at (i) a position substantially (or acoustically) equivalent to the canceling location (a position that can be considered as the canceling location), and (ii) a position where the airflow does not reach the error microphone 55. The control speaker 54 is situated at a position where the phase of the artificial noise at the position of the error microphone 55 is identical to the phase of the artificial noise at the canceling location. The reference microphone 53, the control speaker 54, and the error microphone 55 are arranged such that a secondary time of arrival is shorter than a primary time of arrival. The secondary time of arrival corresponds to a time period in which the artificial noise travels from the control speaker 54 and arrives at the canceling location. The primary time of arrival corresponds to a time period in which the target noise travels from the position of the reference microphone 53 and arrives at the canceling location. During the time period corresponding to the difference between the primary time of arrival and the secondary time of arrival, a process to produce the artificial noise is executed.

The control speaker 54 emits the artificial noise toward the outside of the housing 30. The error microphone 55 detects a synthesized sound discharged from the discharge port 361. The synthesized sound corresponds to the combined sound of the target noise and the artificial noise. The error microphone 55 outputs a second detection signal indicating the detected synthesized sound. The control speaker 54 has an ability to emit a sound that is sufficiently louder than the target noise. The error microphone 55 has an ability to receive the synthesized sound without distortion.

[1-2. Drive Controller]

Figure 8:
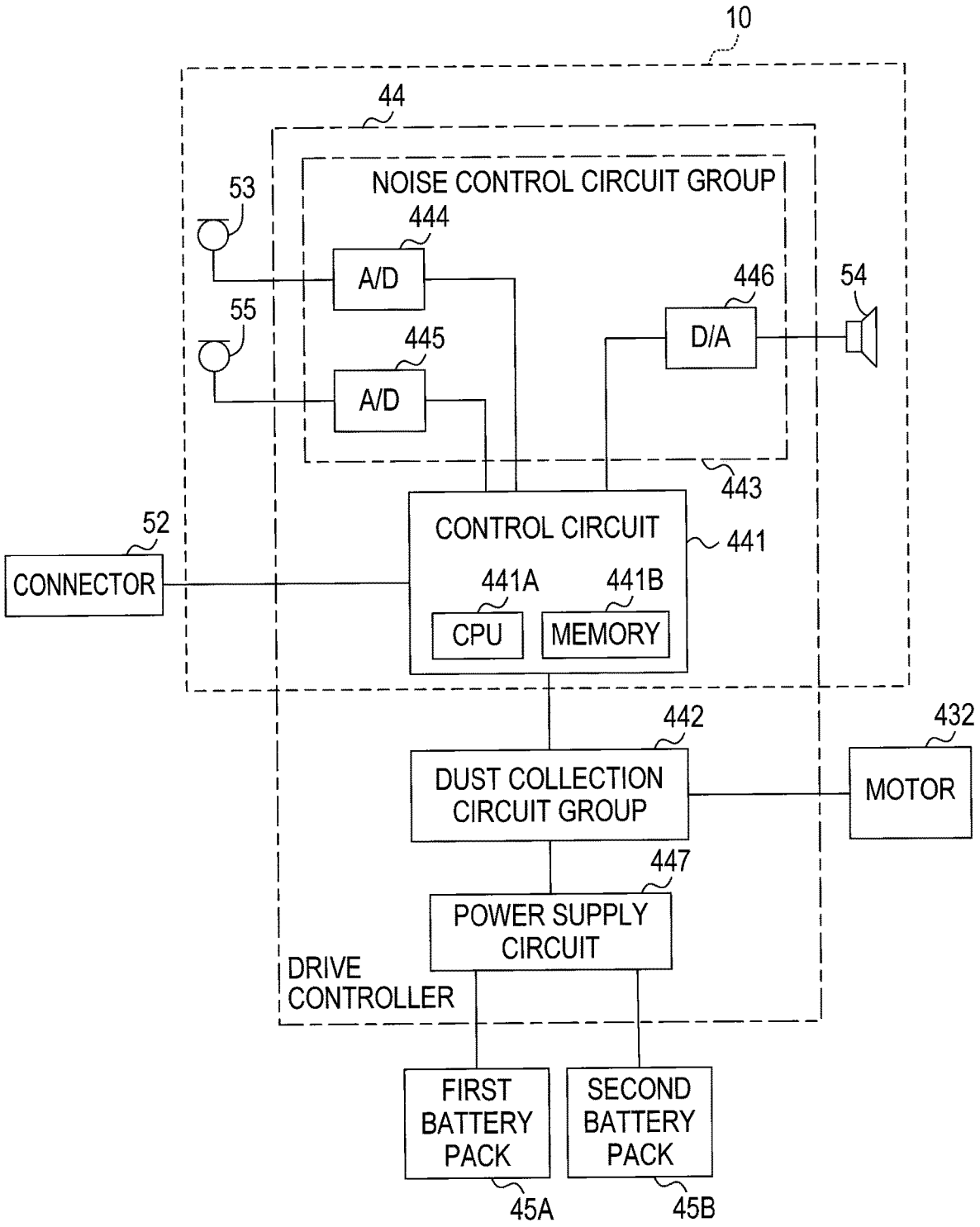
FIG. 8 is a block diagram illustrating the electrical configuration of the dust collector.

As illustrated in FIG. 8, the drive controller 44 includes a control circuit 441, a dust collection circuit group 442, a noise control circuit group 443, and a power supply circuit 447. The dust collector 1 includes a noise controller 10. As illustrated in FIG. 8, the noise controller 10 and the drive controller 44 have some part thereof in common.

The power supply circuit 447 generates a power supply voltage from an electric power fed from the first battery pack 45A and/or the second battery pack 45B. The power supply circuit 447 feeds (or applies) the generated power supply voltage to each part of the dust collector 1.

The control circuit 441 in the first embodiment is in the form of, for example, a microcomputer. Specifically, the control circuit 441 includes a CPU 441A and a memory 441B. The control circuit 441 may include a combination of electronic components, such as discrete devices, in place of or in addition to the microcomputer. The control circuit 441 may include a digital signal processor (DSP), an application specific integrated circuit (ASIC) and/or an application specific standard product (ASSP). The control circuit 441 may include a programmable logic device that is rewritable. The programmable logic device may include, for example, a field programmable gate array (FPGA). The control circuit 441 may include a combination of the microcomputer, the DSP, the ASIC, the ASSP and/or the programmable logic device.

The dust collection circuit group 442 includes various types of circuits that are necessary to perform the function of the dust collector 1. The dust collection circuit group 442 in the first embodiment includes a motor drive circuit, a battery switching circuit, and a fault (or failure) detection circuit. The motor drive circuit drives the motor 432. The battery switching circuit switches the power supply source between the first battery pack 45A and the second battery pack 45B depending on the remaining energies (or remaining electric power) of the first and second battery packs 45A, 45B. The fault detection circuit detects various types of faults (or failures) in relation to driving of the motor 432.

The noise control circuit group 443 includes various types of circuits that are necessary to perform the function of the noise controller 10. The noise control circuit group 443 includes a first analog/digital (A/D) converter 444, a second A/D converter 445, and a digital/analog (D/A) converter 446.

The first A/D converter 444 receives a first detection signal from the reference microphone 53. The first A/D converter 444 converts the first detection signal to digital data and feeds the digital data into the control circuit 441. A reference signal $x_n$ (see FIG. 9), which will be described later, corresponds to the digital data fed from the first A/D converter 444. The second A/D converter 445 receives the second detection signal from the error microphone 55. The second A/D converter 445 converts the second detection signal to digital data and feeds the digital data into the control circuit 441. An error signal $e_n$ (see FIG. 9), which will be described later, corresponds to the digital data fed from the second A/D converter 445. The D/A converter 446 receives digital data (a control signal $u_n$ to be described later) outputted from the control circuit 441. The D/A converter 446 converts the control signal $u_n$ to an analog signal and feeds the analog signal into the control speaker 54.

The control circuit 441 controls the dust collection circuit group 442, thereby achieving the function of the dust collector 1. Moreover, the control circuit 441 executes a noise reduction process, thereby achieving the function to reduce the noise generated by the dust collector 1 (that is, the function of the noise controller 10).

The noise controller 10 includes the control circuit 441 that executes the noise reduction process, the noise control circuit group 443, the reference microphone 53, the control speaker 54, and the error microphone 55.

The control circuit 441 executes the noise reduction process, thereby achieving feed-forward active noise control (ANC).

[1-3. ANC Model]

Figure 9:
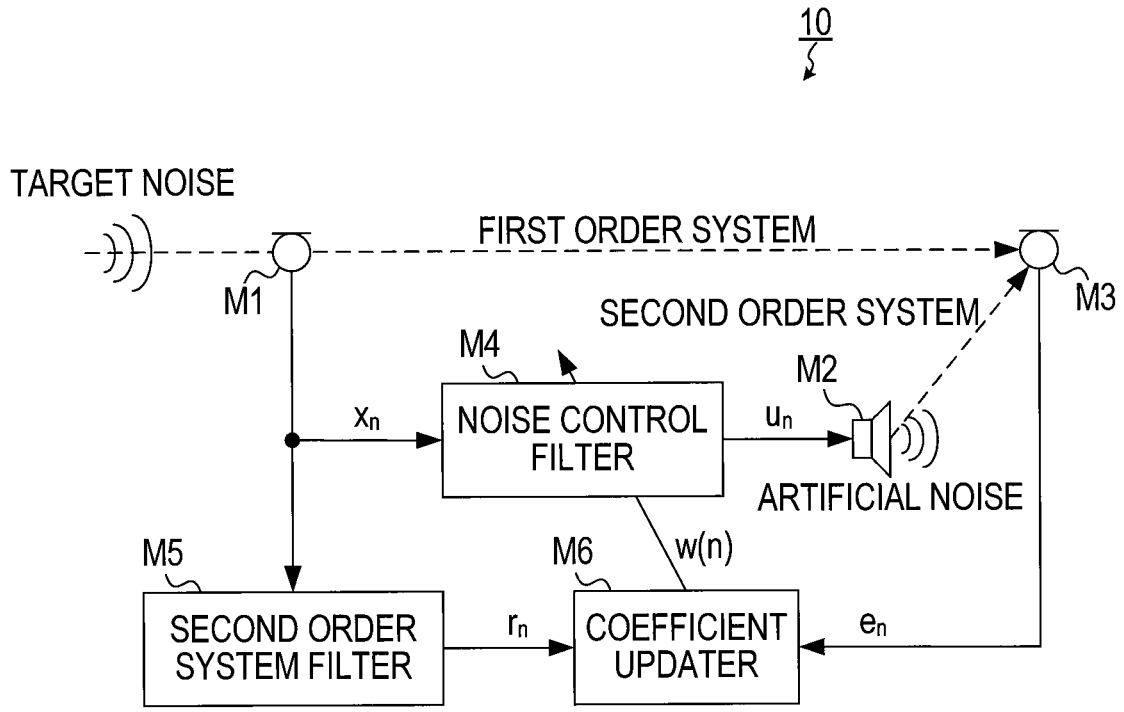
FIG. 9 is a block diagram of a model of a feed-forward ANC system.

Referring now to FIG. 9, a feed-forward ANC model (hereinafter simply referred to as "ANC model") achieved by the noise controller 10 is described. The noise controller 10 can be represented by the control model (specifically, the ANC model) illustrated in FIG. 9.

As illustrated in FIG. 9, the ANC model includes a reference sensor M1, a control sound source M2, an error sensor M3, a noise control filter M4, a second order system filter M5, and a coefficient updater M6. The reference sensor M1 corresponds to the reference microphone 53 and the first A/D converter 444. The control sound source M2 corresponds to the D/A converter 446 and the control speaker 54. The error sensor M3 corresponds to the error microphone 55 and the second A/D converter 445. The noise control filter M4, the second order system filter M5, and the coefficient updater M6 correspond to the control circuit 441. Specifically, the noise control filter M4, the second order system filter M5, and the coefficient updater M6 are achieved by execution of corresponding processes by means of the control circuit 441 in accordance with computer programs. However, the noise control filter M4, the second order system filter M5, and the coefficient updater M6 may be partly or entirely achieved by hardware (or hardwired system).

The reference sensor M1 generates the reference signal $x_n$. The reference signal $x_n$ corresponds to digital data indicating the target noise detected by the reference microphone 53 (specifically, the first detection signal), that is, the digital data outputted from the first A/D converter 444. The subscript "n" as in the reference signal $x_n$ indicates that it is the $n^{th}$ sample data.

Figure 10:
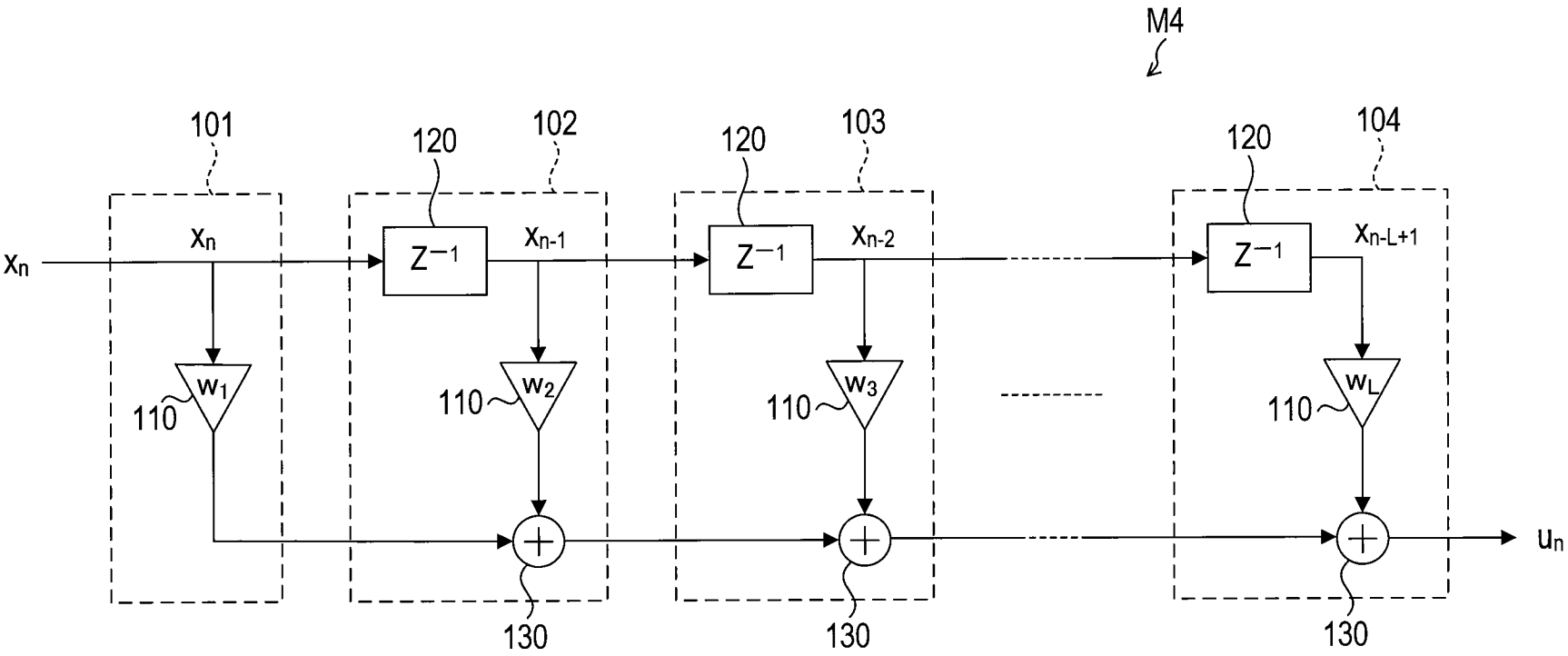
FIG. 10 is a block diagram illustrating an example configuration of a noise control filter.

In the first embodiment, the noise control filter M4 is in the form of a digital filter, more specifically in the form of a finite impulse response (FIR) filter, such as the one exemplified in FIG. 10. As illustrated in FIG. 10, the noise control filter M4 includes L taps where "L" is a positive integer. More specifically, the noise control filter M4 includes a first tap 101, a second tap 102, a third tap 103, . . . and an $L^{th}$ tap 104. Each of the $2^{nd}$ to $L^{th}$ taps 102 to 104 includes a delay device 120 and an adder 130. The delay device 120 introduces a delay of one sampling period to a signal inputted to the delay device 120 and outputs the delayed signal. Each of the $1^{st}$ to $L^{th}$ taps 101 to 104 includes a multiplier 110 in which the coefficient of the corresponding tap is set. For example, a coefficient $w_1$ is set in the multiplier 110 of the first tap 101, a coefficient $w_3$ is set in the multiplier 110 of the third tap 103, and a coefficient $w_L$ is set in the multiplier 110 of the $L^{th}$ tap 104. In the noise control filter M4, operations schematically illustrated by a block diagram in FIG. 10 are performed. The operations are executed, for example, in accordance with computer programs in the present embodiment as mentioned above. By the operations, a control signal $u_n$ is generated from an L-dimensional reference vector x(n). The elements of the L-dimensional reference vector x(n) are L reference signals $\{x_n, x_{n-1}, \ldots, x_{n-L+1}\}$ that are most recently detected.

The control sound source M2 produces the artificial noise in accordance with the control signal $u_n$.

The error sensor M3 generates the error signal $e_n$. The error signal $e_n$ corresponds to digital data indicating the synthesized sound (that is, the second detection signal) detected by the error microphone 55, that is, the digital data outputted from the second A/D converter 445.

Hereinafter, a sound propagation path from the reference sensor M1 to the error sensor M3 is referred to as "first order system" while a sound propagation path from the control sound source M2 to the error sensor M3 is referred to as "second order system".

Figure 11:
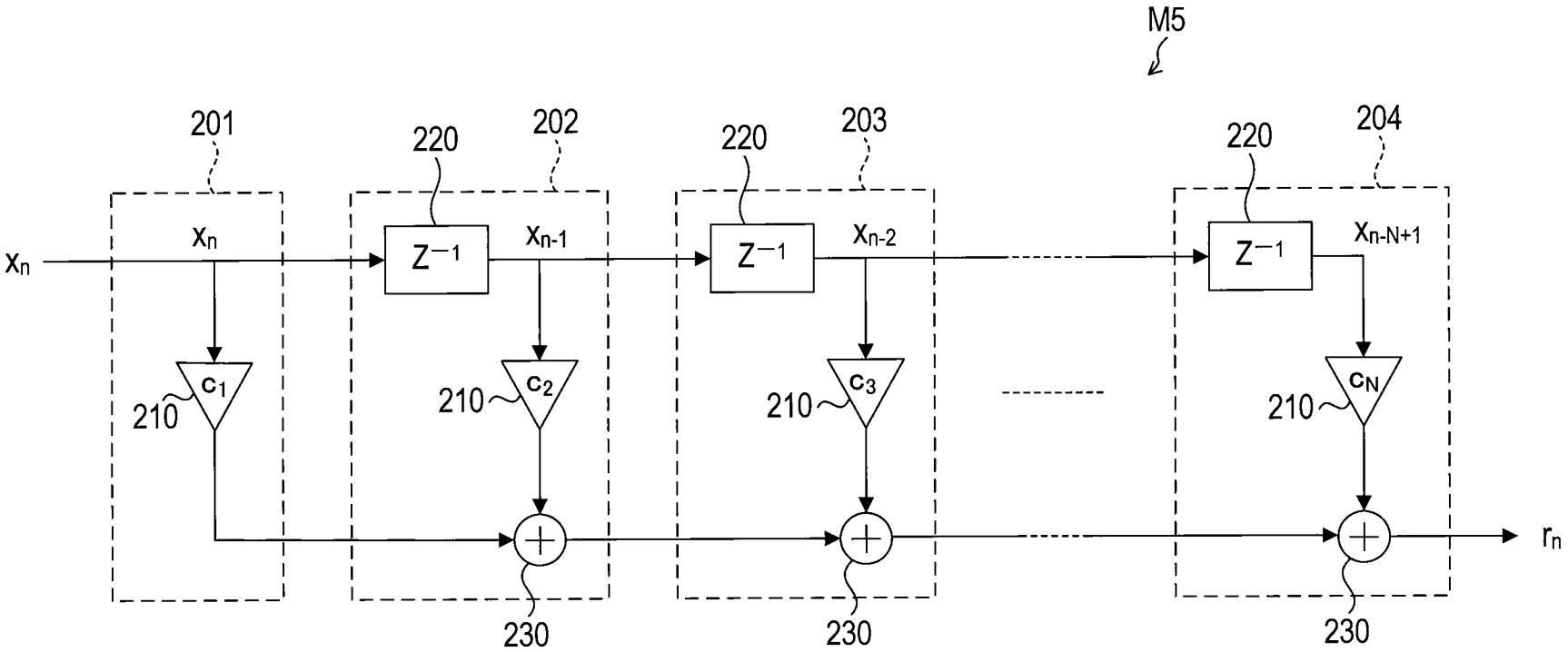
FIG. 11 is a block diagram illustrating an example configuration of a second order system filter.

In the first embodiment, the second order system filter M5 is in the form of a digital filter, more specifically in the form of an FIR filter, such as the one exemplified in FIG. 11. As illustrated in FIG. 11, the second order system filter M5 includes N taps where "N" is a positive integer. More specifically, the second order system filter M5 includes a first tap 201, a second tap 202, a third tap 203, . . . and an $N^{th}$ tap 204. Each of the $2^{nd}$ to $N^{th}$ taps 202 to 204 includes a delay device 220 and an adder 230. The delay device 220 introduces a delay of one sampling period to an input signal and outputs the delayed signal. Each of the $1^{st}$ to $N^{th}$ taps 201 to 204 includes a multiplier 210 in which the coefficient of the corresponding tap is set. For example, a coefficient $c_1$ is set in the multiplier 210 of the first tap 201, a coefficient $c_2$ is set in the multiplier 210 of the second tap 202, and a coefficient $c_N$ is set in the multiplier 210 of the $N^{th}$ tap 204. In the second order system filter M5, operations schematically illustrated by a block diagram in FIG. 11 are performed. The operations are executed, for example, in accordance with computer programs in the present embodiment as mentioned above. By the operations, a filtered reference signal $r_n$ is generated from an N-dimensional reference vector x(n). The elements of the N-dimensional reference vector x(n) are N reference signals $\{x_n, x_{n-1}, \ldots x_{n-N+1}\}$ that are most recently detected. The second order system filter M5 corresponds to a filter modeled on the transfer characteristics of the second order system. The coefficient of each tap in the second order system filter M5 is, for example, a fixed value. The filtered reference signal $r_n$ corresponds to a signal generated by imparting the influence of the second order system to the reference signal $x_n$. The influence of the second order system is added on to the artificial noise having arrived the error sensor M3.

The coefficient updater M6 updates the coefficients $\{w_1, w_2, w_L\}$ of the L taps included in the noise control filter M4 such that the error signal $e_n$ becomes the lowest by noise cancellation or noise attenuation between the target noise and the artificial noise at the position of the error sensor M3 (that is, a position that can be considered as the canceling location). Hereinafter, the L-dimensional vector having the coefficients $\{w_1, w_2, \ldots, w_L\}$ as its elements are referred to as "coefficient vector w(n)".

The coefficients of the noise control filter M4 may be updated with, for example, the Filtered-x LMS algorithm that is one of adaptive algorithms.

In the noise controller 10, the total number of taps L of the noise control filter M4 has a size that corresponds to the length of time within which the impulse response of the first order system sufficiently converges. The total number of taps L is set, for example, in a range from several hundreds to one thousand and several hundreds. The total number of taps N of the second order system filter M5 is L or smaller. The total number of taps N is large enough to complete the noise reduction process within a processing time allotted to the noise reduction process. That is, the total number of taps N of the second order system filter M5 is set depending on the processing capacity of the control circuit 441. Moreover, the total number of taps N of the second order system filter M5 is set to a value smaller than the number corresponding to the length of time within which the impulse response of the second order system sufficiently converges. In other words, the second order system filter M5 represents part of the impulse response of the second order system. More specifically, the second order system filter M5 represents the impulse response of the second order system except the latter half of the response. In other words, the second order system filter M5 reproduces approximate characteristics of the impulse response of the second order system.

Hereinafter, the tap that processes the most recent signal in each of the noise control filter M4 and the second order system filter M5 is defined as the first tap. Moreover, the tap that processes the signal obtained in m sampling period (or interval) before the sampling period in which the most recent signal is obtained is defined as $m+1^{th}$ tap. For example, the fifth tap processes the signal obtained in four sampling periods before the sampling period of the most recent signal. Furthermore, between any two taps, the one with a smaller number is described as a higher-order tap while the one with a larger number is described as a lower-order tap.

The coefficients of the noise control filter M4 are updated by the adaptive algorithm (specifically, by the coefficient updater M6). When the coefficients of the noise control filter M4 indicate a divergence tendency, M taps (specifically, from the first to the $M^{th}$ taps) are used in the noise control filter M4. The letter M represents a positive integer equal to or smaller than N. The positive integer M is experimentally determined in advance by, for example, simulation using the following approach.

From an impulse response P of the first order system and an impulse response C of the second order system estimated in advance, transfer characteristics (hereinafter referred to as "theoretical characteristics") P/C are calculated. The calculation of P/C means an operation to multiply P by 1/C (in other words, to divide P by C). That is, 1/C means an inverse response of the impulse response C of the second order system. For example, assume that the theoretical characteristics P/C are the true values of the noise control filter M4 (that is, the true value of each coefficient of the noise control filter M4, and thus the true values of the transfer characteristics of the noise control filter M4). Then, for each of the coefficients $w_1$ to $w_L$ of the taps in the noise control filter M4 when a divergence tendency is detected, the deviation from the corresponding true value is calculated. Subsequently, out of the taps with deviations as large as or larger than a given threshold, the highest-order tap and the taps lower than the highest-order tap are eliminated. The number of the remaining taps after the elimination may be determined as M.

Alternatively, for example, the number of taps M may be determined by a first approach described below. That is, for each of the coefficients $w_1$ to $w_L$ of the taps of the noise control filter M4, the square value SLa of the coefficient of the lowest-order tap is calculated. Moreover, the sum of squares SUa of the taps higher than the lowest-order tap is calculated. Then, the square value SLa and the sum of squares SUa are compared. If the result of the comparison is "$\alpha \times SUa < SLa$", the lowest-order tap is eliminated. The number that a represents is larger than zero and smaller than one, and may be, for example, ½. If the lowest-order tap is eliminated, the same process is performed with respect to the rest of the taps. This process is repeated until "$\alpha \times SUa \geq SLa$" is established. Then, the number of remaining taps when "$\alpha \times SUa \geq SLa$" is established may be determined as M.

Alternatively, for example, the number of taps M may be determined by a second approach described below. That is, in the L taps, a first tap group and a second tap group are determined as appropriate, which will be described below. Each of the first and second tap groups includes two or more consecutive taps. The taps in the first tap group are higher in order than taps in the second tap group. The sum of squares SUb of the coefficients of the taps in the first tap group, and the sum of squares SLb of the coefficients of the taps in the second tap group, are calculated. Then, the sum of squares SLb and the sum of squares SUb are compared. If the result of the comparison is "$\alpha \times SUb < SLb$", the second tap group may be eliminated and the number of remaining taps may be determined as M. It does not have to be the entire second tap group to be eliminated. One or more consecutive tap(s) of the second tap group including the highest-order tap may be kept uneliminated.

Each of the first and second tap groups may be determined in any suitable manner. For example, the $1^{st}$ tap to $p^{th}$ tap may be assigned to the first tap group, and the $p+1^{th}$ tap to $L^{th}$ tap may be assigned to the second tap group. In this case, the $p^{th}$ tap may be any one of the $3^{rd}$ tap to $L-2^{th}$ tap. More specifically, the $p^{th}$ tap may be, for example, any one of the $P1^{th}$ tap to $P2^{th}$ tap. P1 may be, for example, L/3 (if the number is indivisible, the decimal may be rounded up to the whole number, for example), and P2 may be, for example, 2L/3 (if the number is indivisible, the decimal may be rounded up to the whole number, for example). Alternatively, the $p^{th}$ tap may be, for example, the middle tap (or the tap almost at the middle) of L taps.

Each of the first and second tap groups may include any number of taps. The first tap group does not have to include the $1^{st}$ tap which is the highest in the order. The second tap group does not have to include the $L^{th}$ tap which is the lowest. The taps in the second tap group do not have to be taps consecutive to taps in the first tap group. For example, there may be one or more tap(s) between the first and second taps groups that is/are not included in the first and second tap groups.

In the above-described comparison, if the result is "$\alpha \times SUb \geq SLb$", the each of the first and second tap groups may be redetermined, for example. Specifically, for example, one or more tap(s) from the lowest in the present first tap group may be eliminated from the first tap group. Alternatively or additionally, one or more taps) that is/are consecutive tap(s) of the highest tap in the present second tap group may be added to the second tap group. Then, the above-described comparison may be made again based on the first and second tap groups that are redetermined in this manner.

The number of taps M may be determined by the combination of the above-described first and second approaches. For example, the number of taps M may be first temporarily determined by the second approach. Then, the first approach may be applied to the temporarily determined the $1^{st}$ tap to $M^{th}$ tap to determine the number of taps M.

[1-4. Process]

[1-4-1. Noise Reduction Process]

Referring now to the flow chart of FIG. 12, the noise reduction process executed by the control circuit 441 will be described. The noise reduction process is repeatedly executed with the same period as the sampling period of the first and second A/D converters 444, 445. The sampling period is set to a period that corresponds to twice the maximum frequency of the target noise. The period in which the noise reduction process is executed is referred to as "processing cycle".

The control circuit 441 includes a first shift register, a second shift register, a third shift register, and L registers (hereinafter referred to as "first register group"). The control circuit 441 uses the first shift register for calculations related to the noise control filter M4. In the first shift register, L reference signals $x_n$ (that is, the L-dimensional reference vector x(n)) are sequentially stored. The control circuit 441 uses the second shift register for calculations related to the second order system filter M5. In the second shift register, N reference signals $x_n$ to $x_{n-N+1}$ (that is, the N-dimensional reference vector x(n)) are sequentially stored. The control circuit 441 uses the third shift register for calculations related to the coefficient updater M6. In the third shift register, L filtered reference signals $r_n$ to $r_{n-L+1}$ (that is, the filtered reference vector r(n)) are sequentially stored. The control circuit 441 stores the results of processing executed in the coefficient updater M6 in the first register group. More specifically, the L coefficients $w_1$ to $w_L$ (that is, the coefficient vector w(n)) to be fed into the noise control filter M4 are stored in the first register group. A coefficient "$w_1$" represents the coefficient of the $i^{th}$ tap.

When the control circuit 441 is activated, a divergence flag FL is initialized to zero (that is, OFF). Moreover, when the control circuit 441 is activated, the coefficients of the L taps in the noise control filter M4, that is the coefficient vector w(n), are initialized to a preset initial value. If updated values of the coefficient vector w(n) are not converging (that is, tend to diverge), the divergence flag FL is set to one (that is, ON). The initial values of the coefficient vector w(n) may be values indicating, for example, the theoretical characteristics P/C (specifically, the coefficient of each tap in the digital filter in which the theoretical characteristics P/C are embodied). Alternatively, the initial values of the coefficient vector w(n) may be set to, for example, a given value/given values (for example, all set to one).

Figure 12:
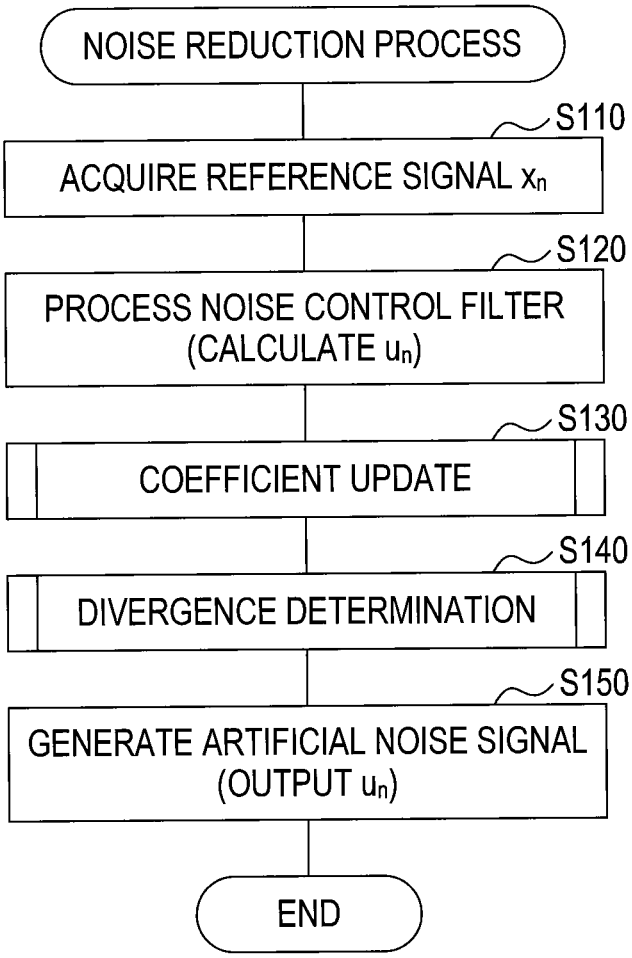
FIG. 12 is a flow chart of a noise reduction process.

As illustrated in FIG. 12, in response to an initiation of the noise reduction process, the control circuit 441 acquires the reference signal $x_n$ in S110. The control circuit 441 stores the acquired reference signal $x_n$ in each of the first and second shift registers.

In S120, the control circuit 441 executes a process to perform the function of the noise control filter M4. Specifically, the control circuit 441 calculates the control signal $u_n$ using the reference vector x(n) stored in the first shift register and the coefficient vector w(n) stored in the first register group. Specifically, the control circuit 441 calculates the control signal $u_n$ in accordance with Formula (1).

$$u_n = \sum_{i=1}^{L}(x_{n-i+1} \times w_i) \tag{1}$$

In S130, the control circuit 441 executes a coefficient update process. The coefficient update process includes updating the coefficient vector w(n) of the noise control filter M4 in accordance with the adaptive algorithm.

In S140, the control circuit 441 executes a divergence determination process including (i) adjusting the configuration of the noise control filter M4 and (ii) not adjusting the configuration of the noise control filter M4. The (i) adjusting the configuration of the noise control filter M4 is executed when the coefficient vector w(n) calculated in the coefficient update process indicates a divergence tendency. The (ii) not adjusting the configuration of the noise control filter M4 is executed when the coefficient vector w(n) calculated in the coefficient update process does not indicate a divergence tendency.

In S150, the control circuit 441 outputs the control signal $u_n$ calculated in S120 to the D/A converter 446. The control signal $u_n$ is converted to an analog signal by the D/A converter 446 and fed into the control speaker 54. Accordingly, the control speaker 54 produces the artificial noise based on the control signal $u_n$.

[1-4-2. Coefficient Update Process]

Referring now to the flow chart in FIG. 13, details of the coefficient update process in S130 will be described.

In response to an initiation of the coefficient update process, the control circuit 441 executes the process in S210 to function as the second order system filter M5. Specifically, the control circuit 441 calculates the filtered reference signal $r_n$ using the N-dimensional reference vector x(n) stored in the second shift register and N coefficients $c_1$ to $c_N$ preset in the taps of the second order system filter M5. Specifically, the control circuit 441 calculates the filtered reference signal $r_n$ in accordance with Formula (2). The control circuit 441 stores the calculated filtered reference signal $r_n$ in the third shift register.

$$r_n = \sum_{i=1}^{N}(x_{n-i+1} \times c_i) \tag{2}$$

In S220, the control circuit 441 calculates the sum of square $R_n$ of the L elements included in the filtered reference vector r(n) stored in the third shift register. The filtered reference vector r(n) is an L-dimensional vector having most recently calculated L filtered reference signals $\{r_n, r_{n-1}, \ldots, r_{n-L+1}\}$ as its elements. Hereinafter, the sum of square $R_n$ is referred to as "normalized value".

In S230, the control circuit 441 acquires the error signal $e_n$. The error signal $e_n$ is a scalar value. In S240, the control circuit 441 calculates a gradient vector S(n).

As expressed in Formula (3), the gradient vector S(n) corresponds to the product of the filtered reference vector r(n) stored in the third shift register and the error signal $e_n$ acquired in S230. The gradient vector S(n) indicates the direction toward which the coefficient vector w(n) varies in the L-dimensional coordinate space representing the coefficient vector w(n).

$$S(n)=e_n \times r(n) \tag{3}$$

In S250, the control circuit 441 updates the coefficient vector w(n) using Formula (4). The control circuit 441 stores the updated coefficient vector w(n+1) in the first register group. Accordingly, the coefficient vector w(n+1) is fed into the noise control filter M4. In Formula (4), the letter μ corresponds to a scalar value for adjusting the speed of convergence and the estimated accuracy of an adaptive operation. Hereinafter, the scalar value μ is referred to as "updating step size". Examples of the updating step size μ may include a specified fixed value.

$$w(n+1) = w(n) + \frac{\mu \cdot S(n)}{R_n} \tag{4}$$

[1-4-3. Divergence Determination Process]

Figure 14:
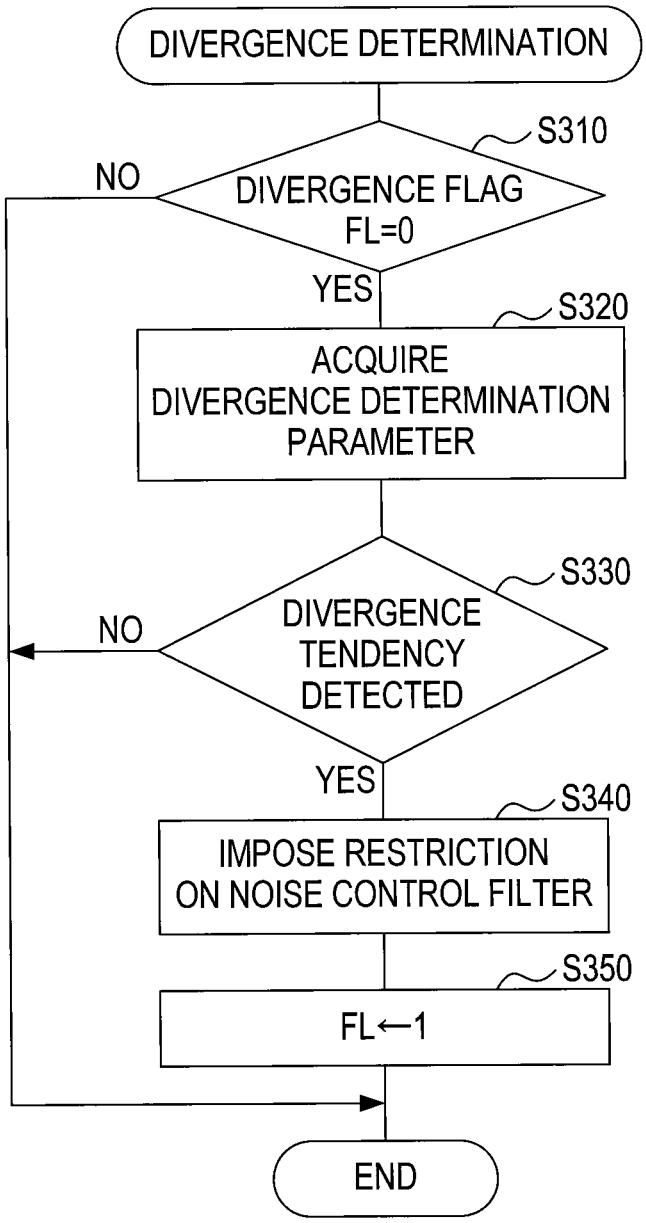
FIG. 14 is a flow chart of a divergence determination process.

Referring now to the flow chart in FIG. 14, details of the divergence determination process in S140 will be described.

In response to an initiation of the divergence determination process, the control circuit 441 determines in S310 whether the divergence flag FL is set to OFF (specifically, FL=0). If the divergence flag FL is set to ON (specifically, FL=1), the control circuit 441 terminates the divergence determination process. If the divergence flag FL is set to OFF, the process proceeds to S320.

In S320, the control circuit 441 acquires a divergence determination parameter that is used for divergence determination. The divergence determination includes determining whether the coefficient vector w(n) updated in S130 indicates a divergence tendency. The divergence determination parameter includes a first determination parameter, a second determination parameter, and/or a third determination parameter. For divergence determination, at least one parameter of the first to third determination parameters is used.

The first determination parameter is a value obtained by subtracting the amount of deviation in a low-order tap group in the noise control filter M4 from the amount of deviation in a high-order tap group. The amount of deviation in the high-order tap group corresponds to the degree to which the coefficients of the taps in a first high-order tap group deviate from the respective true values. The first high-order tap group corresponds to A taps that are from the $1^{st}$ tap to $A^{th}$ tap. The amount of deviation in the low-order tap group corresponds to the degree to which the coefficients of the taps in a first low-order tap group deviate from the respective true values. The first low-order tap group corresponds to L−A taps that are from the $A+1^{th}$ tap to $L^{th}$ tap. The amount of deviation in each tap group may be, for example, the sum of squares of the deviations of the coefficients from the respective true values, or the sum of the absolute values of the deviations of the coefficients from the respective true values. The number of taps A in the first high-order tap group may be the same as the number of taps M used in the noise control filter M4 when the coefficient vector w(n) indicates a divergence tendency.

The second determination parameter is an absolute value of the error signal $e_n$.

The third determination parameter corresponds to the magnitude of a difference vector. The difference vector corresponds to the vector obtained by subtracting the coefficient vector w(n+1) after updating from the coefficient vector w(n) before updating. The magnitude of the difference vector may be, for example, the sum of squares of the elements included in the difference vector, or the sum of the absolute values of the elements.

In S330, the control circuit 441 determines whether the coefficients of the noise control filter M4 tend to diverge, using the divergence determination parameter acquired in S320. In response to a determination that the coefficients of the noise control filter M4 tend to diverge, the control circuit 441 proceeds to S340. In response to a determination that the coefficients of the noise control filter M4 do not tend to diverge, the control circuit 441 terminates the divergence determination process.

Specifically, if the first determination parameter is used as the divergence determination parameter, the control circuit 441 may determine a divergence tendency in response to the first determination parameter being a negative value. The first determination parameter being a negative value means that the amount of deviation in the low-order tap group is larger than the amount of deviation in the high-order tap group.

If the second determination parameter is used as the divergence determination parameter, the control circuit 441 may determine a divergence tendency in response to the second determination parameter being at or above a threshold. The threshold may be set based on, for example, the maximum noise value tolerated in the noise controller 10. The threshold may be, for example, twice the maximum noise value. The control circuit 441 may determine a divergence tendency in response to a monotonic increase in the second determination parameter over two or more (for example, three) processing cycles.

If the third determination parameter is used as the divergence determination parameter, the control circuit 441 may determine a divergence tendency in response to a monotonic increase in the third determination parameter over two or more (for example, three) processing cycles.

To determine a divergence tendency, any combination of the first to third determination parameters may be used. The control circuit 441 may use two or more parameters out of the first to third determination parameters. In this case, the control circuit 441 may determine a divergence tendency in response to, for example, at least one of the used parameters indicating a divergence tendency. For another example, the control circuit 441 may determine a divergence tendency in response to any two or more parameters out of the used parameters each indicating a divergence tendency.

In S340, the control circuit 441 imposes a restriction on the noise control filter M4. M taps from the $1^{st}$ tap to $M^{th}$ tap in the noise control filter M4 will be simply referred to as "second high-order tap group", and L−M taps from $M+1^{th}$ to $L^{th}$ taps will be simply referred to as "second low-order tap group". Imposing a restriction on the noise control filter M4 may include, for example, setting each of the coefficients $w_{M+1}$ to $w_L$ of the second low-order tap group to a fixed value. The fixed value may be, for example, identical to the coefficient of the corresponding tap in the low-order tap group (from the $M+1^{th}$ to $L^{th}$ taps) in an imaginary filter that represents the theoretical characteristics P/C. Each fixed value may be set to any given value.

For another example, imposing a restriction on the noise control filter M4 may include disabling each tap in the second low-order tap group and enabling each tap in the second high-order tap group. That is, a restriction may be imposed on the noise control filter M4 so that not the disabled taps but the enabled taps are used for calculating the control signal $u_n$. If the process of S340 is executed (specifically, if a restriction is imposed on the noise control filter M4), the control circuit 441 generates the control signal $u_n$ using the noise control filter M4 with a restriction in S120 of the subsequent processing cycle.

In S350, the control circuit 441 sets the divergence flag FL to ON (specifically, FL=1). Based on this setting, the detection of the divergence tendency is stored. After the process of S350 is executed, the control circuit 441 terminates this process.

As described above, in response to a determination that the coefficient vector w(n) of the noise control filter M4 indicates a divergence tendency, a restriction is imposed on the noise control filter M4. Once the restriction is imposed, the restriction is not basically removed while the control circuit 441 is active. After the restriction is imposed, calculation for the control signal $u_n$ using the restricted noise control filter M4 continues until, for example, operation of the control circuit 441 stops.

[1-5. Correspondence of Terms]

In the first embodiment, the noise control filter M4 corresponds to one example of the first digital filter of the present disclosure. The second order system filter M5 corresponds to one example of the second digital filter of the present disclosure. The reference microphone 53 and the first A/D converter 444 (specifically, the reference sensor M1) correspond to one example of the reference acquirer of the present disclosure. The processes of S220 to S250 and S340 correspond to one example of characteristics adjustor of the present disclosure. The processes of S320 to S330 correspond to one example of the divergence determiner of the present disclosure.

[1-6. Effects]

According to the first embodiment described in detail above, the following effects are achieved.

(1a) In the first embodiment, the number of taps N of the second order system filter M5 is set shorter (or lower) than the length (or the number) that corresponds to the length of time period within which the impulse response of the second order system sufficiently converges. This reduces the amount of the computing processing necessary for noise control.

(1b) In the first embodiment, the coefficients $w_1$ to $w_L$, of all the taps (L taps) included in the noise control filter M4 are updated before a divergence tendency is detected. On the other hand, after a divergence tendency is detected, the coefficients $w_{M+1}$ to $w_L$ of the second low-order tap group are set to fixed values or are disabled so that the coefficients $w_1$ to $w_M$ of the second high-order tap group are updated. This inhibits the coefficients of the noise control filter M4 from diverging even if the second order system filter M5 includes a second order system estimation error. The second order system estimation error means an error of the second order system filter M5. More specifically, the second order system estimation error indicates the difference between the actual characteristics of the second order system and the characteristics represented by the second order system filter M5. If the number of taps N of the second order system filter M5 is set to an insufficient length, a measurable error may occur in the second order system estimation error.

(1c) In the first embodiment, the error microphone 55 is situated at a position where the airflow generated by the drive unit 43 does not reach the error microphone 55. In other words, the error microphone 55 is situated at a position where noise except the target noise is inhibited from entering the error microphone 55. The noise except the target noise may include, for example, wind noise generated by the airflow directly hitting the error microphone 55. Moreover, the error microphone 55 is situated at a position that can be considered as the canceling location. The control speaker 54 is arranged such that the phase of the artificial noise from the control speaker 54 is the same at the canceling location and at the position of the error microphone 55. This results in an enhancement of the coherence between the reference signal $x_n$ detected by the reference microphone 53 and the error signal $e_n$ detected by the error microphone 55, improving control accuracy in reducing the target noise.

[1-7. Influence of Error of Second Order System on Coefficients of Noise Control Filter]

The following describes principles of inhibiting a divergence by imposing a restriction on the noise control filter M4 in response to a detection of a divergence tendency.

First, the significant influence of the second order system estimation error on the coefficients of the noise control filter M4 will be described.

Figure 23:
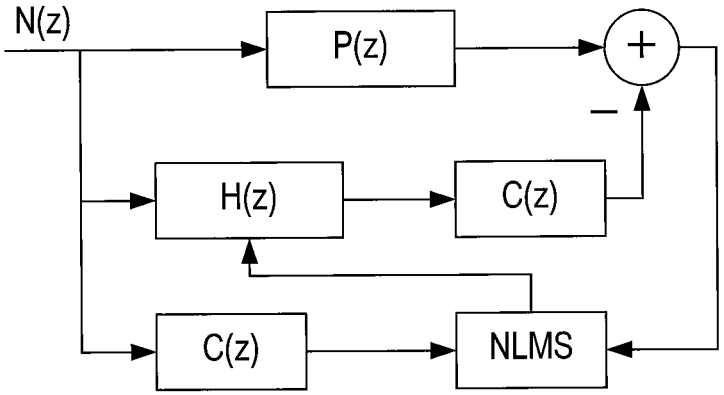
FIG. 23 is a block diagram of a model of an ANC system used for calculating errors of the second order system.
Figure 24:
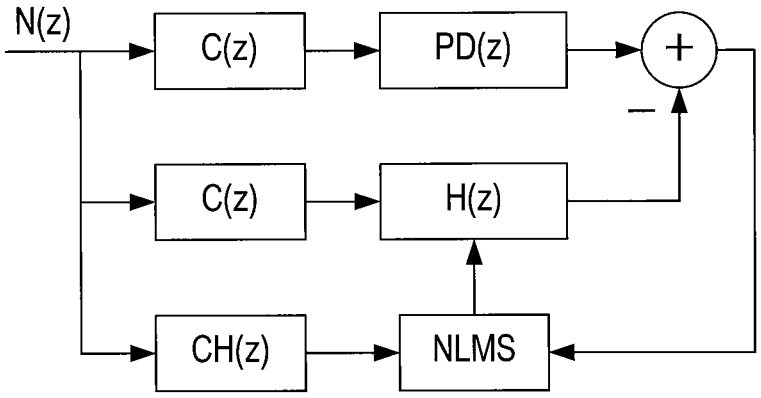
FIG. 24 is an equivalent block diagram of the block diagram in FIG. 23 with some modifications.
Figure 25:
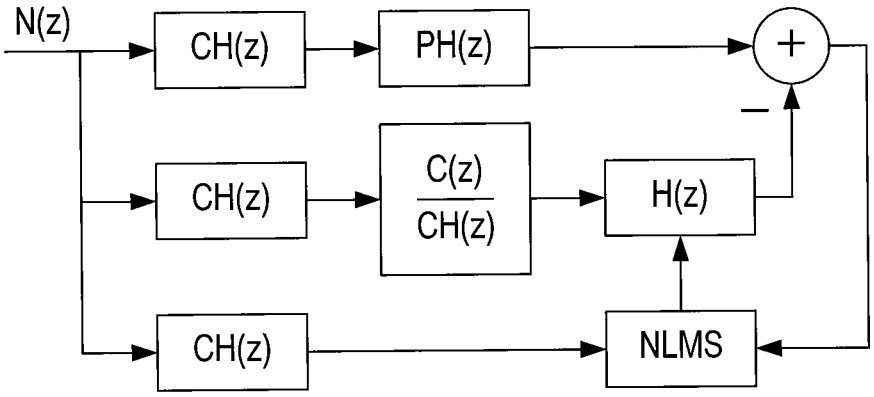
FIG. 25 is an equivalent block diagram of the block diagram in FIG. 24 with further modifications.

In FIGS. 23 to 25, P(z) represents a z-transform of the characteristics of the first order system. H(z) represents a z-transform of the characteristics of the noise control filter M4. C(z) represents a z-transform of the characteristics of the second order system. CH(z) represents a z-transform of the characteristics of the second order system filter M5. The characteristics of the second order system filter M5 (specifically, the coefficient of each tap) are set prior to execution of ANC by estimating the characteristics C(z) of the second order system. The coefficient of each tap in the second order system filter M5 is, for example, a fixed value as described above. N(z) represents a z-transform of the target noise. NLMS represents the coefficient updater M6 according to the learning identification method. In this analysis, the feedback system from the control sound source M2 to the reference sensor M1 is assumed to be negligible. In this case, the structure of the feed-forward ANC (control model) is illustrated in FIG. 23.

In the case where the coefficients of the noise control filter M4 are slowly updated by the coefficient updater M6, the noise control filter M4 is assumed to be a linear filter. In this case, it is theoretically possible to reverse the connection order of the second order system and the noise control filter M4 as illustrated in FIG. 24.

In this case, however, P(z) representing the characteristics of the first order system in FIG. 23 is replaced with PD(z) expressed in Formula (5) as illustrated in FIG. 24.

$$PD(z) = \frac{P(z)}{C(z)} \tag{5}$$

In the structure illustrated in FIG. 24, assuming that the characteristics CH(z) of the second order system filter M5 have no errors (specifically, CH(Z)=C(z)), the signal inputted to the first order system (the characteristics PD(z)), the signal inputted to the noise control filter M4 (the characteristics H(z)), and the signal inputted from the second order system filter M5 to the coefficient updater M6 (NLMS) match one another. In this case, the characteristics 11(z) of the noise control filter M4 converge to the characteristics PD(z) of the first order system. As a result of the convergence of the characteristics 11(z) to PD(z), the characteristics H(z) are adjusted to Hopt(z) expressed in Formula (6) (in other words, the characteristics H(z) converge to Hopt (z)). When the characteristics H(z) are adjusted to Hopt(z), the target noise is, in theory, completely canceled out by the artificial noise based on the control signal outputted from the adjusted characteristics H(z) (specifically, Hopt(z)). Hereinafter, Hopt(z) will be referred to as "characteristics of the optimum noise control filter".

$$H_{opt}(z) = PD(z) = \frac{P(z)}{C(z)} \tag{6}$$

In actual use (for example, when the control model in FIG. 24 is implemented on the control circuit 441), the estimated value of the second order system (specifically, the characteristics of the second order system filter M5) CH(z) includes a second order system estimation error Δ(z). The second order system estimation error Δ(z) corresponds to the difference between estimated characteristics CH(z) and the actual characteristics C(z) of the second order system. In this case, the characteristics CH(z) are expressed by Formula (7).

$$CH(z)=C(z)+\Delta(z) \tag{7}$$

In order to consider an influence of the second order system estimation error Δ(z), each of the two characteristics C(z) of the second order system in FIG. 24 are replaced with the characteristics CH(z) of the second order system filter M5. In this case, the characteristics PD(z) of the first order system in FIG. 24 are replaced with the characteristics PH(z) expressed in Formula (8) as illustrated in FIG. 25.

$$PH(z) = \frac{P(z)}{CH(z)} = \frac{P(z)}{C(z) + \Delta(z)} \tag{8}$$

As it can be seen from FIG. 25, when the characteristics H(z) of the noise control filter M4 are adjusted to satisfy Formula (9), that is, when the characteristics H(z) of the noise control filter M4 converge to Formula (10), the target noise is completely canceled out in theory.

$$\frac{C(z)}{CH(z)} \cdot H(z) = PH(z) \tag{9}$$

$$H(z) = PH(z) \cdot \frac{CH(z)}{C(z)} = \frac{P(z)}{C(z)} \tag{10}$$

In reality, however, it is not possible in the noise control filter M4 to handle the characteristics H(z) separately between a C(z)/CH(z) and PH(z). Accordingly, the characteristics of the noise control filter M4 are updated such that the coefficients converge to HD(z) as expressed in Formula (11). AD(z) in Formula (11) is expressed by Formula (12).

$$HD(z) = \frac{C(z)}{CH(z)} \cdot H_{opt}(z) = \frac{C(z)}{CH(z)} \cdot \frac{P(z)}{C(z)} = \frac{P(z)}{CH(z)} \tag{11}$$

-continued $$= \frac{P(z)}{C(z)+\Delta(z)} = \frac{P(z)}{C(z)} \cdot \frac{1}{1+\frac{\Delta(z)}{C(z)}}$$

$$= H_{opt}(z) \cdot \frac{1}{1+\Delta D(z)}$$

$$\Delta D(z) = \frac{\Delta(z)}{C(z)} \tag{12}$$

It is understood from Formulae (11) and (12) that the second order system estimation error Δ(z) does not deteriorate the noise reduction effect in a simple cumulative manner. Specifically, the second order system estimation error Δ(z) is incorporated in the characteristics HD(z) of the noise control filter M4 as convolution with the characteristics Hopt(z) of the optimum noise control filter. The second order system estimation error Δ(z) is incorporated in the characteristics HD(z) as described above, thereby deteriorating the noise reduction effect.

The degree of deterioration in the noise reduction effect caused by this convolution is clarified. The difference between the characteristics Hopt(z) of the optimum noise control filter and the converged characteristics HD(z) of the noise control filter M4 is expressed in Formula (13).

$$H_{opt}(z) - HD(z) = H_{opt}(z) - H_{opt}(z) \cdot \frac{1}{1+\Delta D(z)} = H_{opt}(z) \cdot \frac{\Delta D(z)}{1+\Delta D(z)} \tag{13}$$

It is understood from Formula (13) that, if ΔD(z) is sufficiently small, the difference between the converged characteristics HD(z) of the noise control filter M4 and the characteristics Hopt(z) of the optimum noise control filter is convolution of Hopt(z) and ΔD(z).

As a result of a conversion of Formula (11), Formula (14) is obtained.

$$HD(z) = H_{opt}(z) \cdot \frac{1}{1+\Delta D(z)} = H_{opt}(z)\left[1 + \{-\Delta D(z)\} + \{-\Delta D(z)\}^2 + \dots\right] \tag{14}$$

As described above, if the characteristics CH(z) of the second order system filter M5 include an error from the actual characteristics C(z) of the second order system, the noise reduction effect of ANC is deteriorated. The second and subsequent terms on the right side of Formula (14) correspond to the degree of the deterioration in the noise reduction effect.

Next, a case is described where enough taps cannot be provided in the second order system filter M5, specifically where the number of taps in the second order system filter M5 is smaller than the number corresponding to the length of time necessary for the impulse response of the second order system to sufficiently converge.

If the second order system filter M5 cannot be provided with enough taps, the second order system estimation error Δ(z) increases. The characteristics CH(z) of the second order system filter M5 are expressed by Formula (15) where "d" indicates the number of taps in the second order system filter M5.

$$CH(z) = C(z) - \Delta(z) \cdot z^{-d} = C(z)\{1 - \Delta D(z) z^{-d}\} \tag{15}$$

In the formula, $\Delta(z)z^{-d}$ represents a z-transform of a portion of the impulse response in the second order system that is terminated (specifically removed) due to insufficiency of taps. For simplification of the description, the coefficient of each tap from the $1^{st}$ tap to the $d-1^{th}$ tap is assumed to include no error.

In this case, the converged characteristics HD(z) of the noise control filter M4 are expressed by Formula (16). In Formula (16), the difference between the converged characteristics HD(z) of the noise control filter M4 and the characteristics Hopt(z) of the optimum noise control filter is expressed in the second and subsequent terms on the right side of the formula as in Formula (14).

$$HD(z) = \frac{P(z)}{C(z) - \Delta(z)z^{-d}} = \frac{P(z)}{C(z)} \cdot \frac{1}{1 - \Delta D(z)z^{-d}} = H_{opt}(z)\left[1 + \{\Delta D(z)\}z^{-d} + \{\Delta D(z)\}^2 z^{-2d} + \dots\right] \tag{16}$$

It is understood from Formula (16) that the termination (removal) of the latter half of the impulse response in the second order system filter M5 affects only the $d^{th}$ and subsequent coefficients in the noise control filter M4. Accordingly, even if the second order system filter M5 cannot be provided with enough taps, it is possible to achieve the noise reduction effect (specifically, to inhibit deterioration of the noise reduction effect) by adjusting the number of taps in the noise control filter M4 to a number comparable to the number of taps (d taps) in the second order system filter M5 or smaller.

2. Second Embodiment

[2-1. Differences from First Embodiment]

In a second embodiment, the basic configurations of the dust collector 1 are the same as in the first embodiment. Thus, the differences from the first embodiment will be described in the second embodiment. In the second embodiment, the same numeral references as in the first embodiment indicate the same configurations as those in the first embodiment, and the earlier descriptions of such configurations should be referred to.

In the first embodiment, the coefficients of the noise control filter M4 are updated every processing cycle. In contrast, the coefficients of the noise control filter M4 are updated every two or more processing cycles (hereinafter referred to as "block") in the second embodiment. Furthermore, the number of updating of the coefficients of the noise control filter M4 is also limited in the second embodiment.

[2-2. Process]

Figure 13:
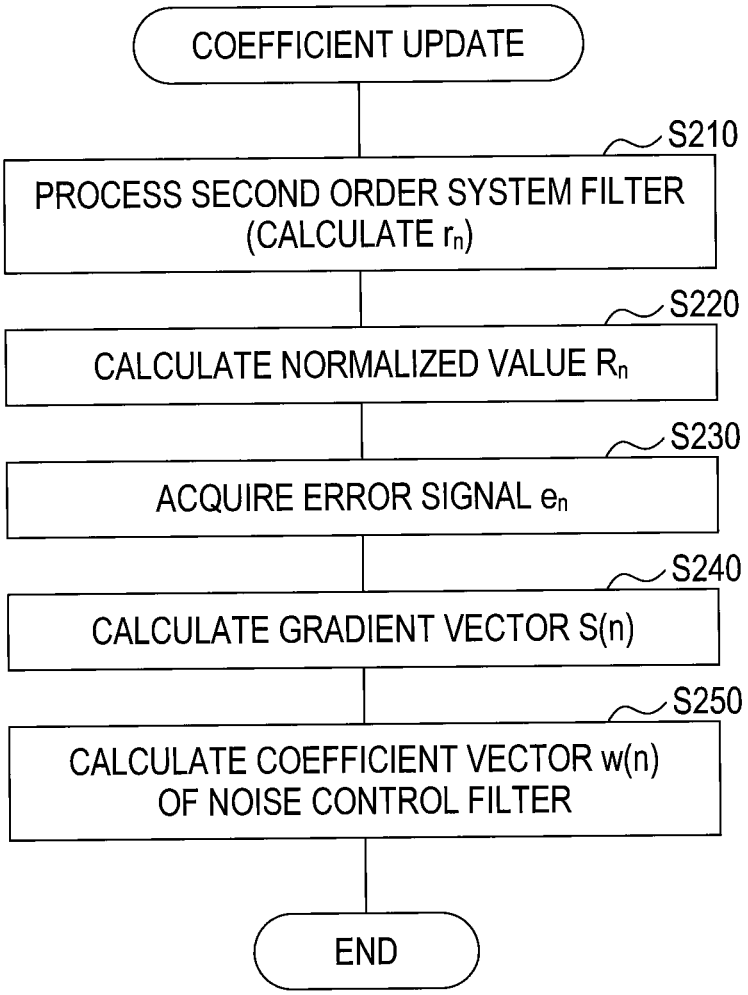
FIG. 13 is a flow chart of a coefficient update process.
Figure 15:
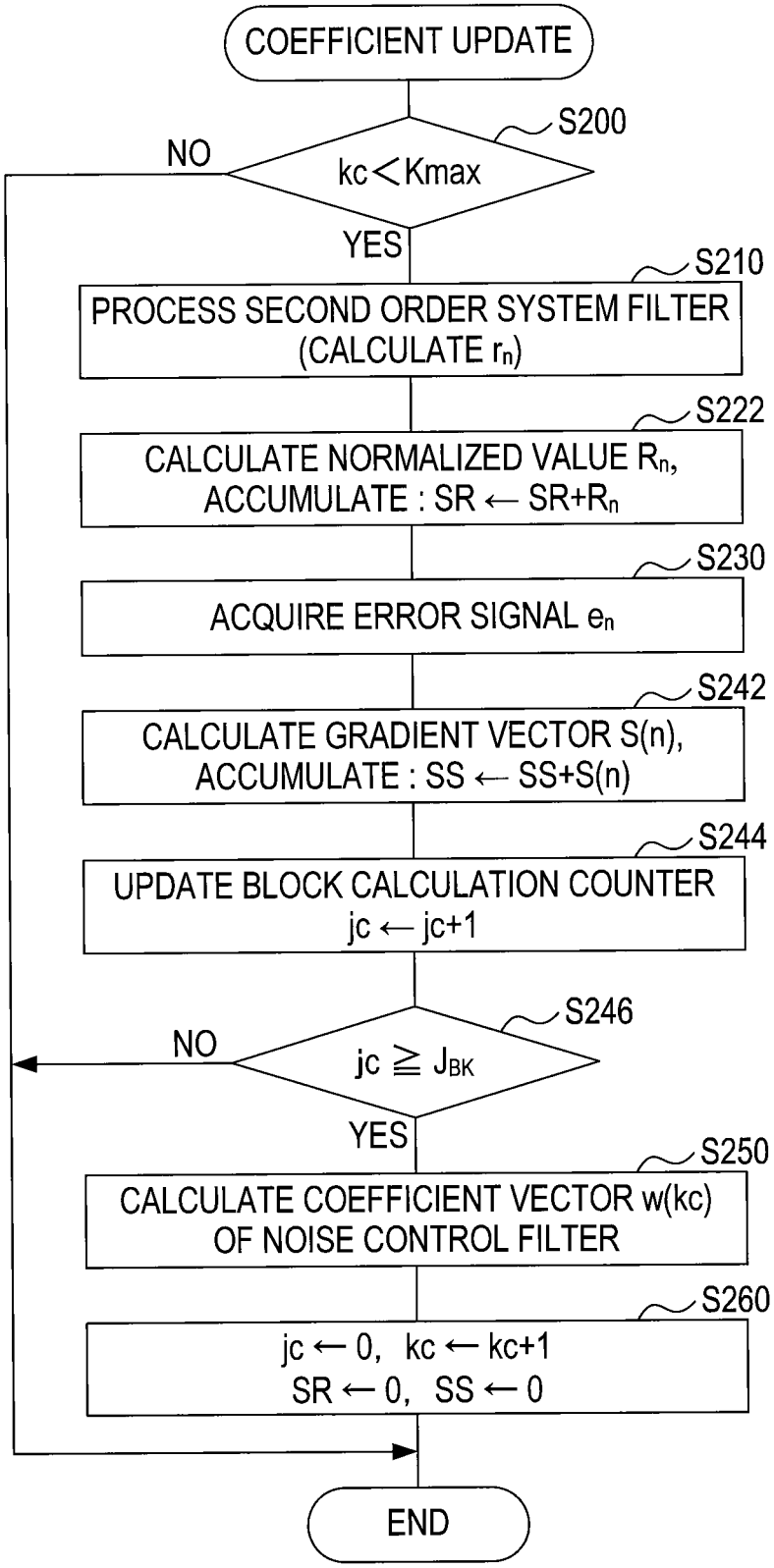
FIG. 15 is a flow chart of a coefficient update process according to a second embodiment.

The control circuit 441 in the second embodiment executes a coefficient update process illustrated in FIG. 15 in place of the coefficient update process illustrated in FIG. 13. In FIG. 15, the same processes as those illustrated in FIG. 13 are given the same step numbers as in FIG. 13. Descriptions of the same processes as in FIG. 13 will be not repeated here. The control circuit 441 includes an update number counter and a block calculation counter. In the following descriptions, the value of the update number counter will be referred to as "first counter value kc", and the value of the block calculation counter will be referred to as "second counter value jc" The control circuit 441, when being activated, initializes the first and second counter values kc, jc (for example, sets to zero). The control circuit 441, when being activated, also initializes a first accumulated value SR and a second accumulated value SS (for example, sets to zero).

The control circuit 441 initiates the coefficient update process, and in S200 determines whether the first counter value kc is smaller than Kmax. Kmax corresponds to the upper limit to the number of updating, that is, the upper limit to the number of times to update the coefficients. If the first counter value kc is at or above Kmax, the control circuit 441 terminates the coefficient update process. If the first counter value kc is smaller than Kmax, the control circuit 441 proceeds to S210.

The process of S210 is the same as in the first embodiment.

In S222, the control circuit 441 calculates the normalized value $R_n$ as in S220 in FIG. 13. In S222, the control circuit 441 further calculates the first accumulated value SR. The first accumulated value SR corresponds to an accumulated value of the normalized value $R_n$. The control circuit 441 cumulatively adds the normalized value $R_n$ calculated in S222 every time it executes the process of S222.

The process of S230 is the same as in the first embodiment.

In S242, the control circuit 441 calculates the gradient vector S(n) as in S240 in FIG. 13. In S242, the control circuit 441 further calculates the second accumulated value SS. The second accumulated value SS corresponds to an accumulated value SS of the gradient vector S(n). The control circuit 441 cumulatively adds the gradient vector S(n) calculated in S242 every time it executes the process of S242.

In S244, the control circuit 441 increments the second counter value jc by one.

In S246, the control circuit 441 determines whether the second counter value jc is at or above $J_{BK}$. $J_{BK}$ corresponds to a block calculation number, that is, the number of processing cycles in one block. In response to a determination that the second counter value jc is smaller than $J_{BK}$, the control circuit 441 terminates the coefficient update process. In response to a determination that the second counter value jc is at or above $J_{BK}$, the control circuit 441 proceeds to S250.

The process of S250 is the same as in the first embodiment. However, the first accumulated value SR is used in place of the normalized value $R_n$, and the second accumulated value SS is used in the place of the gradient vector S(n) in Formula (4).

In S260, the control circuit 441 resets the second counter value jc to zero and increments the first counter value kc by one. After the process of S260, the control circuit 441 terminates the coefficient update process.

That is, the control circuit 441 updates the noise control filter M4 every block (specifically, once in $J_{BK}$ processing cycles) using the first and second accumulated values SR, SS calculated in that block. Update of the noise control filter M4 ends in response to the noise control filter M4 being updated Kmax times.

Each of the values $J_{BK}$ and Kmax may be set to, for example, a value that renders the error signal $e_n$ sufficiently small. The values $J_{BK}$ and Kmax may be set based on experimental results of, for example, simulation.

[2-3. Correspondence of Terms]

In the second embodiment, the process of the coefficient update illustrated in FIG. 15 except S210 corresponds to one example of the characteristics adjustor of the present disclosure.

[2-4. Effects]

According to the second embodiment described in detail above, the following effects are achieved in addition to the effects (1a), (1b), and (1c) of the first embodiment.

(2a) In the second embodiment, the first and second accumulated values SR, SS are used for updating the coefficient vector w(n) of the noise control filter M4. Even if the normalized value $R_n$ and/or the gradient vector S(n) momentarily indicate faulty values (or indicates a faulty value) due to a disturbance, this configuration limits the influence thereof, thereby improving the stability of the coefficient vectors w(n) that are updated.

(2b) In the second embodiment, the number of updating of coefficient vector w(n) of the noise control filter M4 is limited to Kmax. This inhibits the updates of the coefficient vector w(n) from being continued unnecessarily after convergence of the values of the coefficient vector w(n). The coefficient vector w(n), however, may be updated any number of times without a limit.

3. Third Embodiment

[3-1. Differences from First Embodiment]

In a third embodiment, the basic configurations are the same as in the second embodiment. Thus, the differences from the second embodiment will be described in the third embodiment. In the third embodiment, the same numeral references as in the second embodiment indicate identical configurations to those in the second embodiment, and earlier descriptions should be referred to for such configurations.

In the first and second embodiments, the update step size μ used for updating the coefficient vector w(n) of the noise control filter M4 is a fixed value, while, in the third embodiment, the update step size μ is variably set. Moreover, in the third embodiment a divergence tendency is determined based on variations in the update step size μ.

[3-2. Process]

[3-2-1. Coefficient Update Process]

Figure 16:
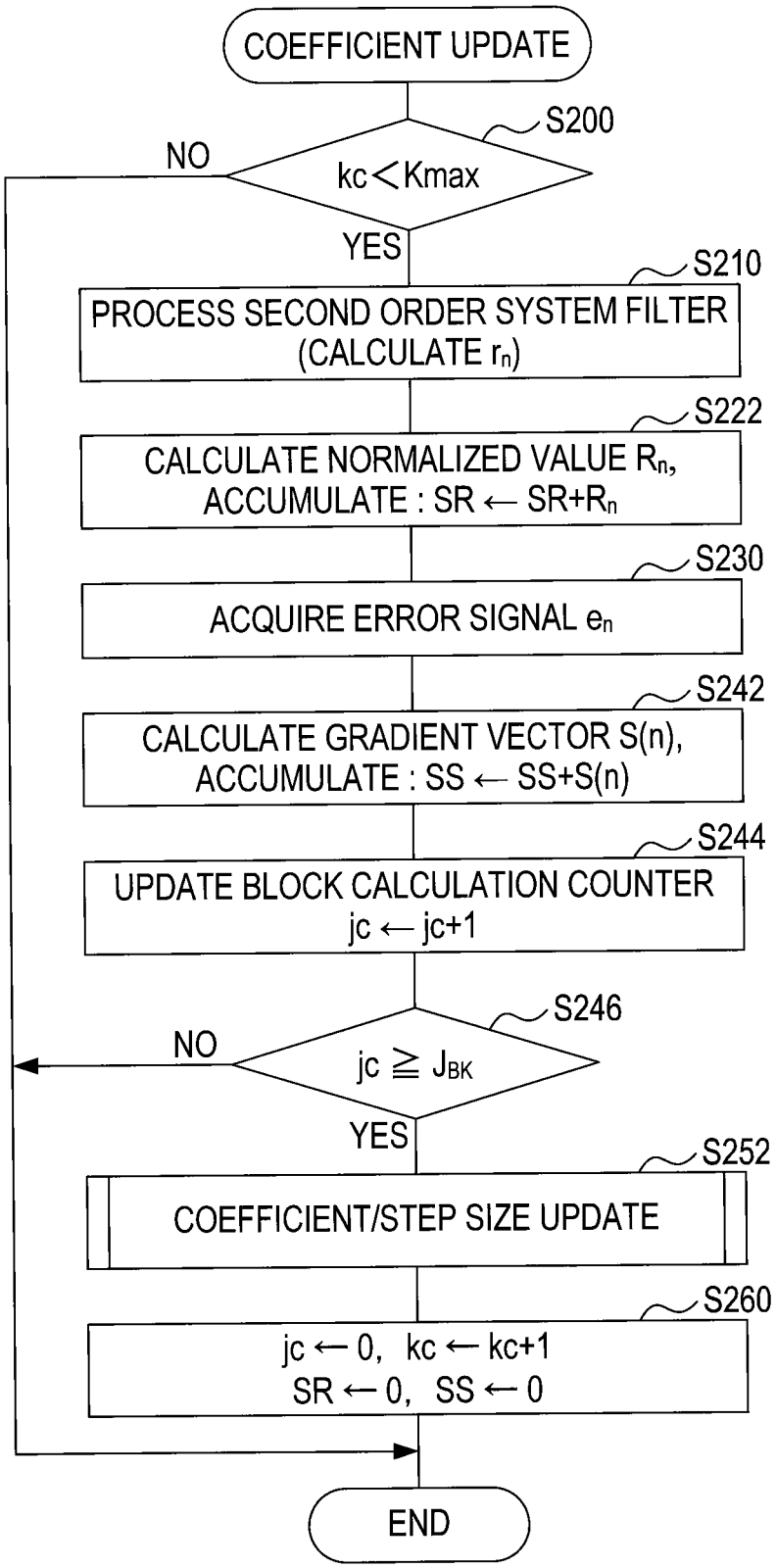
FIG. 16 is a flow chart of a coefficient update process according to a third embodiment.

The noise control circuit 10 in the third embodiment executes a coefficient update process illustrated in FIG. 16 in place of the coefficient update process illustrated in FIG. 15.

As illustrated in FIG. 16, the control circuit 441 executes a coefficient/step size update process in S252 in the coefficient update process of the third embodiment in place of S250 (see FIG. 15) in response to an affirmative determination in S246.

[3-2-2. Coefficient/Step Size Update Process]

Figure 17:
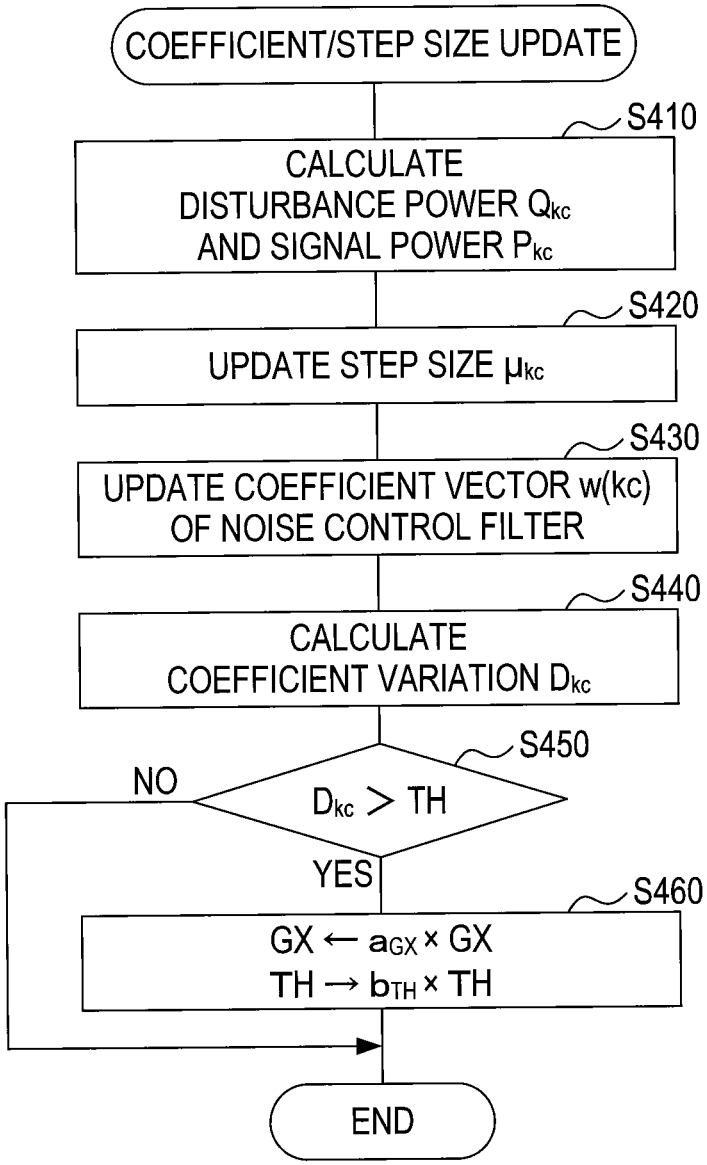
FIG. 17 is a flow chart of a coefficient/step size update process.

Referring now to FIG. 17, details of the coefficient/step size update process in S252 will be described.

In response to an initiation of the coefficient/step size update process in FIG. 17, the control circuit 441 calculates a disturbance power $Q_{kc}$ and a signal power $P_{kc}$ per block in S410. The disturbance power $Q_{kc}$ corresponds to the power of noise except the target noise. The signal power $P_{kc}$ corresponds to the power of the target noise. The disturbance power $Q_{kc}$ may be, for example, a value obtained by accumulating (adding) the square of the error signal $e_n$ of each processing cycle in one block. The signal power $P_{kc}$ may be a value that is obtained by accumulating (adding) the sum of the squares of the reference signal $x_n$ included in the reference vector x(n) of each processing cycle in one block.

In S420, the control circuit 441 updates an update step size $\mu_{kc}$ in accordance with Formula (17) where $I_{TP}$ is the number of taps in the noise control filter M4, $J_{BK}$ is a block length, and GX is a necessary value for an estimation error. An example of the estimation error is the second order system estimation error Δ(z). The necessary value GX is a parameter to determine the minimum accuracy in the estimation error. The necessary value GX may take a value of, for example, 1>GX>0. The initial value $GX_0$ of the necessary value GX is any given value. The initial value $GX_0$ is set to, for example, a value close to one (for example, 0.9).

$$\mu_{kc} = \frac{2 \cdot GX \cdot P_{kc} \cdot J_{BK}}{Q_{kc} \cdot I_{TP} + P_{kc} \cdot GX} \tag{17}$$

In S430, the control circuit 441 updates the coefficient vector w(kc) of the noise control filter M4. The difference between S430 and S250 (see FIG. 13) is that $\mu_{kc}$, which is calculated in S420, is used as the update step size in place of the fixed value μ.

In S440, the control circuit 441 calculates a coefficient variation $D_{kc}$. The coefficient variation $D_{kc}$ corresponds to the change in the magnitude of the coefficient vector w(kc) of the noise control filter M4 updated in S430 (specifically, the change amount from the coefficient vector immediately before the change). The magnitude of the coefficient vector w(kc) may be, for example, the sum of the squares of all the elements of the coefficient vector w(kc), or may be the sum of the absolute values of all the elements.

In S450, the control circuit 441 determines whether the coefficient variation $D_{kc}$ is above a specified determination threshold TH. If the coefficient variation $D_{kc}$ is at or below the determination threshold TH, the control circuit 441 terminates the coefficient/step size update process. If the coefficient variation $D_{kc}$ is above the determination threshold TH, the control circuit 441 proceeds to S460.

In S460, the control circuit 441 updates a necessary value GX and the determination threshold TH in accordance with Formulae (18) and (19). Each of the necessary value GX and the determination threshold TH is a parameter used for changing the update step size $\mu_{kc}$.

$$GX \leftarrow a_{GX} \cdot GX \tag{18}$$

$$TH \leftarrow b_{TH} \cdot TH \tag{19}$$

The term $a_{GX}$ is a necessary value adjustment coefficient and is set to $1>a_{GX}>0$. The term $b_{TH}$ is a threshold adjustment coefficient and is set to $1>b_{TH}>0$. The necessary value adjustment coefficient $a_{GX}$ and the threshold adjustment coefficient $b_{TH}$ are set such that changes in the necessary value GX and the determination threshold TH are small. Specifically, each of the necessary value adjustment coefficient $a_{GX}$ and the threshold adjustment coefficient $b_{TH}$ is set to, for example, a value close to one (such as 0.9).

As described above, in the coefficient/step size update process, the coefficient vector w(kc) of the noise control filter M4 is updated. In the coefficient/step size update process, the update step size $\mu_{kc}$, which is used for calculating the coefficient vector w(kc), is also updated. Furthermore, the necessary value GX and the determination threshold TH, which are used for adjusting the update step size $\mu_{kc}$, are adjusted in the coefficient/step size update process. The necessary value GX and the determination threshold TH are used for adjusting the update step size $\mu_{kc}$.

Adjustment of the necessary value GX and the determination threshold TH is performed when the variation $D_{kc}$ of the coefficient vector w(kc) is larger than the determination threshold TH (specifically, when the coefficient vector w(kc) indicates a divergence tendency). Specifically, for every affirmative determination in S450, the necessary value GX and the determination threshold TH are changed to values smaller than the respective present values.

As the necessary value GX becomes smaller, the update step size $\mu_{kc}$ to be obtained becomes smaller, rendering the variation $D_{kc}$ in the coefficient vector w(kc) also smaller. This inhibits a divergence. However, a small variation $D_{kc}$ hinders a detection of a divergence tendency. In this case, there is possibility that a divergence tendency cannot be detected despite a state where the divergence tendency continues. Thus, the necessary value GX and the determination threshold TH are adjusted in the third embodiment such that the determination threshold TH is decreased in response to a decrease in the necessary value GX.

[3-2-3. Divergence Determination Process]

Figure 18:
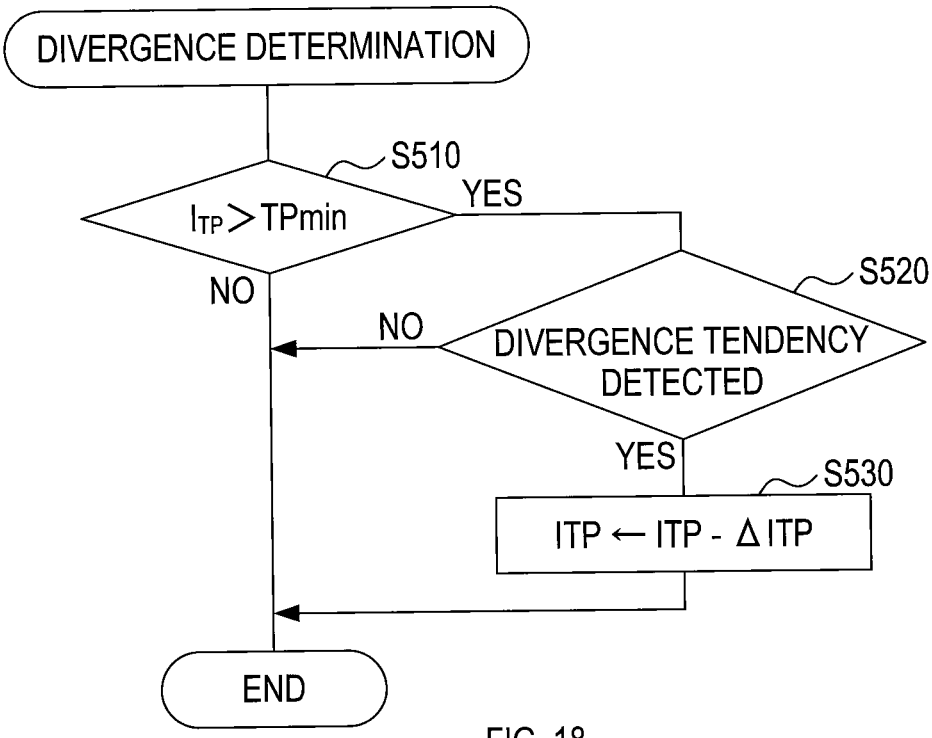
FIG. 18 is a flow chart of a divergence determination process according to the third embodiment.

Referring now to FIG. 18, the divergence determination process in S140 (see FIG. 12) executed by the control circuit 441 of the third embodiment will be described. The control circuit 441 of the third embodiment executes in S140 the divergence determination process illustrated in FIG. 18 in place of the divergence determination process in FIG. 14.

In response to an initiation of the divergence determination process illustrated in FIG. 18, the control circuit 441 determines in S510 whether the number of enabled taps $I_{TP}$ of the noise control filter M4 is larger than a lower limit Tpmin of enabled taps. The number of enabled taps $I_{TP}$ is the number of taps of the noise control filter M4 to be updated by the coefficient updater M6. The lower limit Tpmin is set to, for example, the number of taps N of the second order system filter M5 or smaller. However, the lower limit Tpmin may be set to a value larger than the number of taps N of the second order system filter M5. In response to a determination that the number of enabled taps $I_{TP}$ is at or below the lower limit Tpmin, the control circuit 441 terminates the divergence determination process. In response to a determination that the number of enabled taps $I_{TP}$ is larger than the lower limit Tpmin, the control circuit 441 proceeds to S520.

In S520, the control circuit 441 determines, as in S330 (see FIG. 14), whether the coefficients of the noise control filter M4 indicate a divergence tendency. For determination in S520, the control circuit 441 may use, other than the first to third determination parameters, the coefficient variation $D_{kc}$ calculated in S440 and a variation in the update step size $\mu_{kc}$ (for example, the absolute value $|\mu_{kc}-\mu_{kc-1}|$ of the difference from the previous value) calculated in S420. In this case, the control circuit 441 may determine a divergence tendency in response to, for example, one of or both of the coefficient variation $D_{kc}$ and the variation in the update step size $\mu_{kc}$ being larger than the respective tolerances.

In S530, the control circuit 441 reduces the number of enabled taps $I_{TP}$ of the noise control filter M4 by an adjustment amount $\Delta I_{TP}$ (for example, 50). Specifically, for example, out of the enabled taps, the lowest-order tap and above are disabled as many as the number corresponding to the adjustment amount $\Delta I_{TP}$. After the process of S530 is executed, the control circuit 441 terminates the divergence determination process.

In the noise control filter M4 of the third embodiment, $I_{TP}$ taps from the first to $I_{TP}{}^{th}$ taps are enabled tap while $L-I_{TP}$ taps from the $I_{TP}+1^{th}$ to $L^{th}$ taps are disabled.

In the noise control filter coefficient vector update process in S430, the coefficients of the enabled taps are updated and the coefficients of the disabled taps are set to fixed values. In the noise control filter process in S120, the disabled taps may be used for calculating the control signal $u_n$, or the disabled taps do not have to be used for such calculation.

In the third embodiment, if the variation in the update step size $\mu_{kc}$ is larger than the tolerance, it is determined that the coefficient vector w(kc) of the noise control filter M4 indicates a divergence tendency. In response to every determination of a divergence tendency, the number of enabled taps of the noise control filter M4 is reduced by the adjustment amount $\Delta I_{TP}$ from the lower-order side in S530.

If the update step size $\mu_{kc}$ calculated in one process cycle is large, the coefficient vector w(kc) of the noise control filter M4 is determined to indicate a divergence tendency. Thus, the error signal $e_{kc}$ to be detected in the subsequent processing cycle is large. In this case, the update step size $\mu_{kc}$ to be calculated in the subsequent processing cycle is small as it can be understood from Formula (17). This suppresses the divergence. The same course will be repeated. In other words, a divergence tendency and suppression thereof will be repeated. This repetition causes fluctuation in the update step size $\mu_{kc}$, thereby making it possible to determine whether the system is in a divergence tendency based on the fluctuation in the update step size $\mu_{kc}$.

[3-3. Correspondence of Terms]

In the third embodiment, the process of the coefficient update illustrated in FIG. 16 except S210 and the process of S530 correspond to one example of the characteristics adjustor of the present disclosure. The process of S520 corresponds to one example of the divergence determiner of the present disclosure.

[3-4. Effects]

According to the third embodiment described in detail above, the following effects are achieved in addition to the effects (1a), (1b), and (1c) of the first embodiment and the effects (2a) and (2b) of the second embodiment.

(3a) In the third embodiment, the so-called step size control is used. Specifically, the update step size $\mu_{kc}$ is changed in accordance with the converging state of the coefficient vector w(kc) of the noise control filter M4. Accordingly, it is possible to decrease the estimation error of the coefficient vector w(kc) of the noise control filter M4 to the necessary value GX or smaller, even under a situation where the disturbance power $Q_{kc}$ is fluctuating.

(3b) In the third embodiment, if the variation in the update step size $\mu_{kc}$ exceeds the tolerance, the adjustment in the number of enabled taps of the noise control filter M4 in S530 (specifically, disabling taps by the adjustment amount $\Delta I_{TP}$) is repeated until the update step size $\mu_{kc}$ stabilizes. Accordingly, it is possible to stably update the coefficient vector w(kc) of the noise control filter M4 even under a situation where the disturbance power $Q_{kc}$ is fluctuating.

(3c) In the third embodiment, the necessary value GX and the determination threshold TH are decreased in a step-by-step manner until the changes in the coefficient vector w(kc) converge and the coefficient vector w(kc) stabilizes. Accordingly, it is possible to converge the necessary value GX and thus the update step size $\mu_{kc}$ to respective appropriate values that enable the noise control filter M4 to operate in a stable manner.

4. Fourth Embodiment

[4-1. Differences from First Embodiment]

The differences of the fourth embodiment from the first embodiment lie in the work machine to which the noise controller 10 is applied and the control model of ANC used in the noise control device 10.

[4-2. Configuration of Cleaner]

A handheld vacuum cleaner 8, which is another example of the electric powered work machine of the present disclosure, will be described. In the fourth embodiment, the noise controller 10 is installed in the handheld vacuum cleaner 8. The handheld vacuum cleaner 8 is used while being held by a user of the handheld vacuum cleaner 8. The handheld vacuum cleaner 8 is one embodiment of rechargeable electric cleaners.

Figure 19:
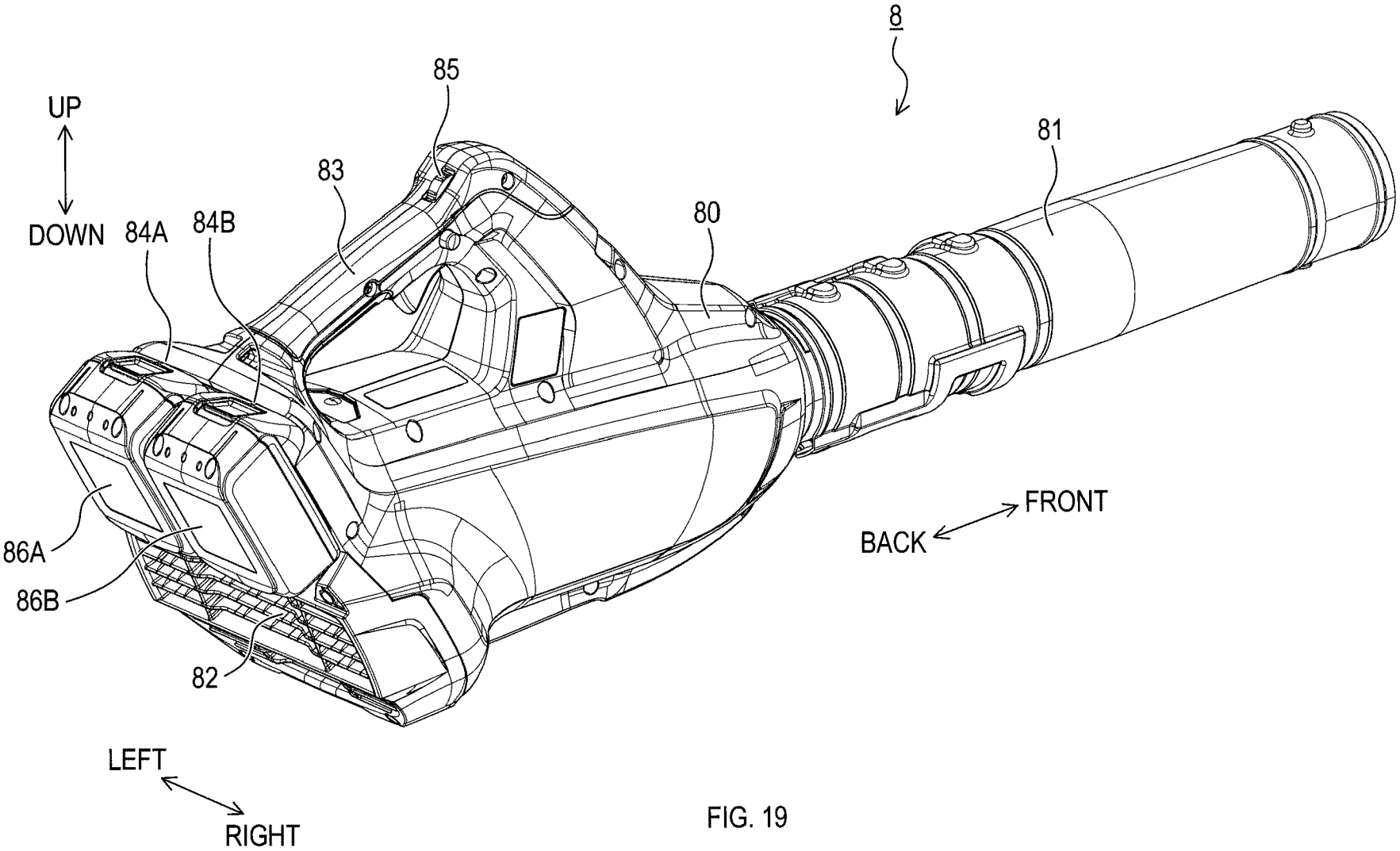
FIG. 19 is a perspective view of the appearance of a handheld vacuum cleaner according to a fourth embodiment.
Figure 20:
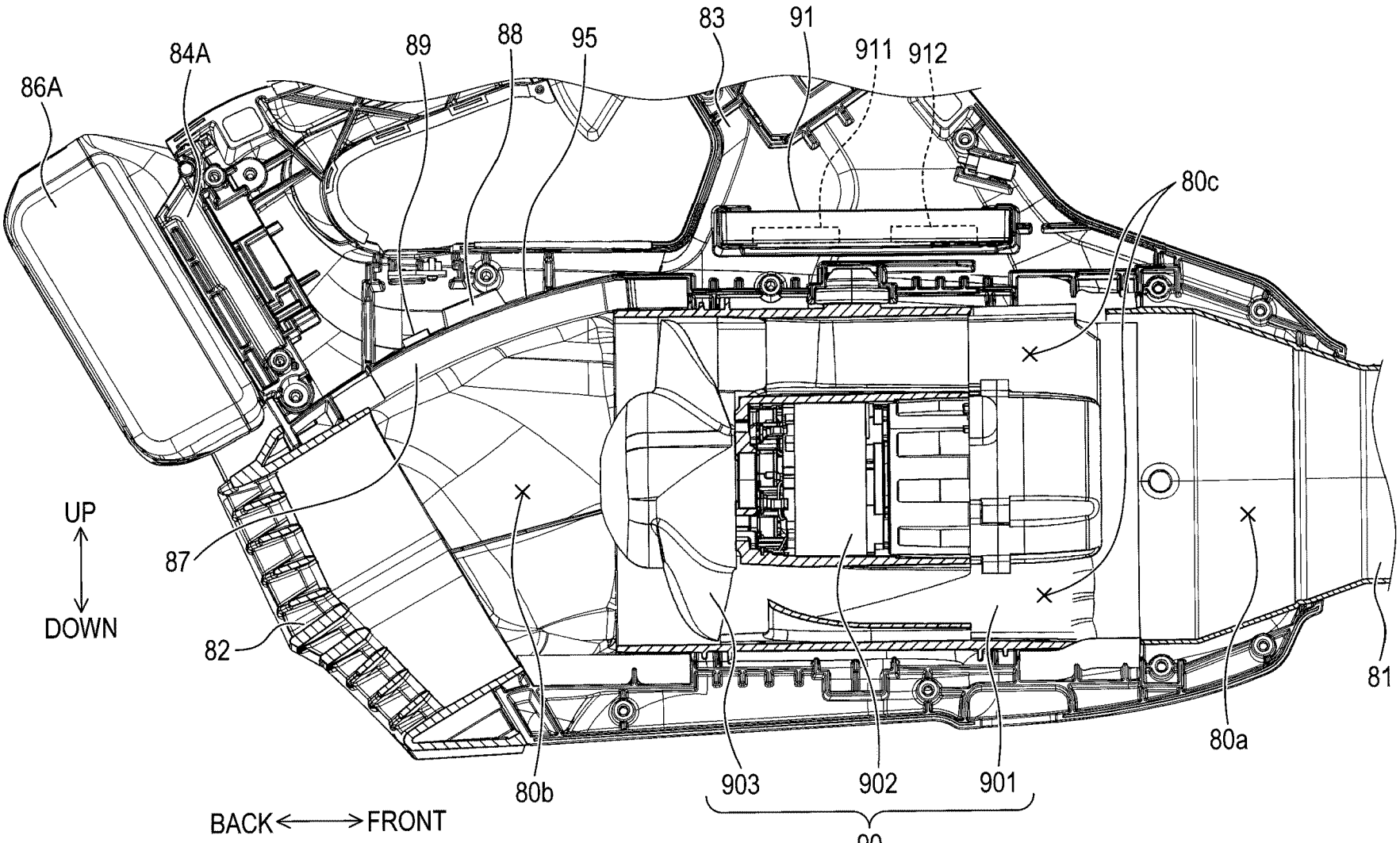
FIG. 20 is a cross-sectional view of the handheld vacuum cleaner.
Figure 21:
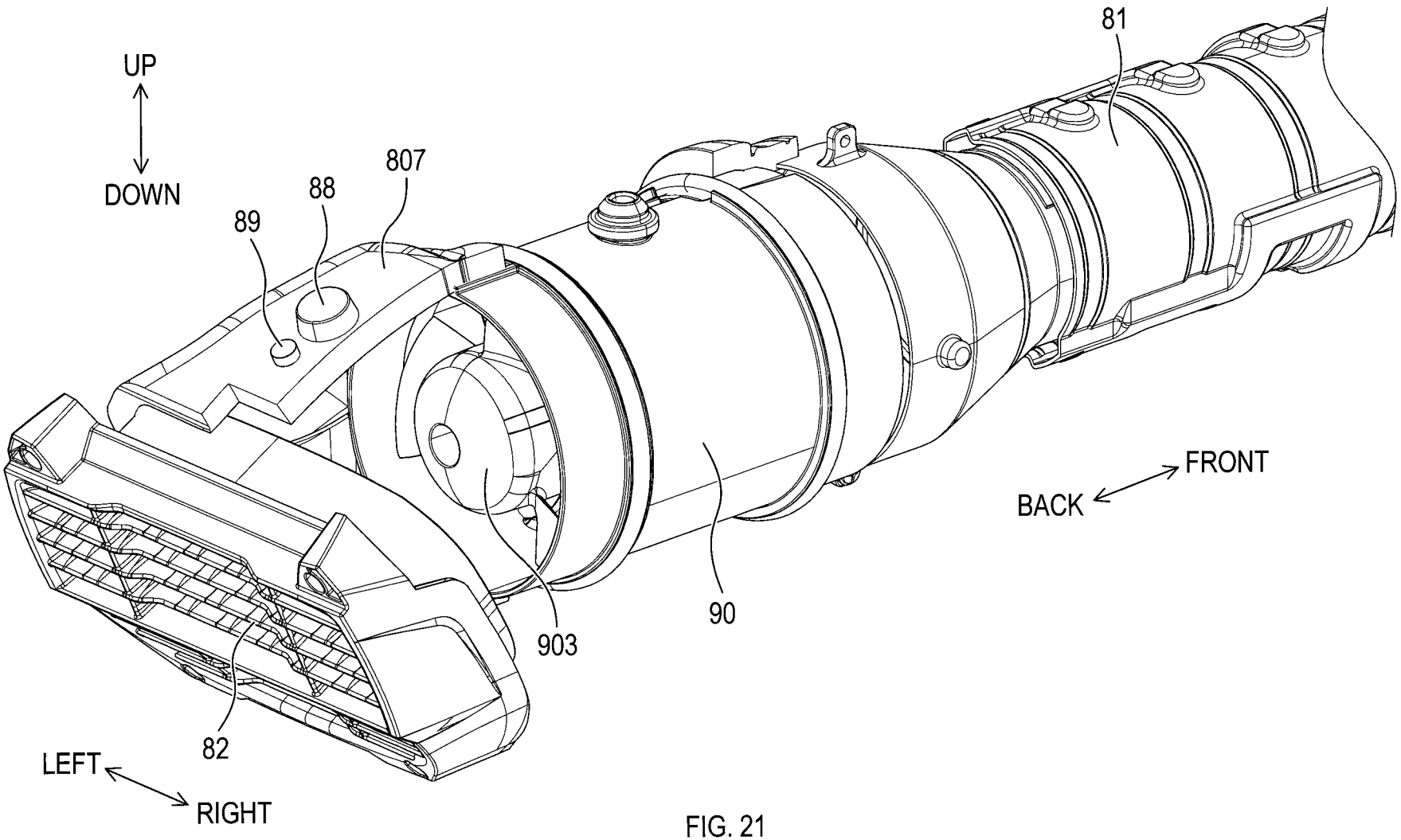
FIG. 21 is a perspective view of the handheld vacuum cleaner in a state with a housing and some components thereof removed and with an error detection microphone and a control speaker attached.

For convenience of description, the direction (front, back, up, down, left, and right) with respect to the handheld vacuum cleaner 8 is defined as illustrated in FIGS. 19 to 21 in the fourth embodiment.

As illustrated in FIGS. 19 to 21, the handheld vacuum cleaner 8 includes a main body housing 80. The main body housing 80 includes a suction port 81, a discharge port 82, a handle 83, a first and a second battery attachment portions 84A, 84B.

The suction port 81 is disposed in the front portion of the main body housing 80. The suction port 81 has a cylindrical shape. The suction port 81 sucks external air. The discharge port 82 is provided in the lower rear portion of the main body housing 80. The discharge port 82 has the shape of slits. The discharge port 82 discharges air with dust removed therefrom. The handle 83 is provided on the upper surface of the main body housing 80 and held by the user. The handle 83 is provided with an electronic switch 85. The user can manipulate the electronic switch 85 while holding the handle 83. The first and second battery attachment portions 84A, 84B are provided on the upper side of the back surface of the main body housing 80. To the first battery attachment portion 84A, a first battery pack 86A is attached. To the second battery attachment portion 84B, a second battery pack 86B is attached.

Inside the main body housing 80, a drive unit 90 and a control circuit board 91 are provided.

In the main body housing 80, the drive unit 90 is provided between the suction port 81 and the discharge port 82. The drive unit 90 is arranged to partition the internal space of the main body housing 80 into a first space 80*a* and a second space 80*b*. In the first space 80*a*, a dust bag (not illustrated) is placed. The main body housing 80 includes an inner wall 95 forming the second space 80*b* and a sound absorbing material 87. The sound absorbing material 87 is provided on the inner wall 95. The sound absorbing material 87 may be a sponge, for example. The main body housing 80 includes a control speaker 88 and an error microphone 89 that are arranged on top of the sound absorbing material 87.

Each of the control speaker 88 and the error microphone 89 is mounted such that each of the control speaker 88 and the error microphone 89 is directional toward the second space 80*b*, and is mounted facing the second space 80*b* with the sound absorbing material 87 provided therebetween. The error microphone 89 is situated such that the airflow does not reach the error microphone 89 inside the main body housing 80.

The error microphone 89 is arranged at a position where an antinode of a standing wave of a noise generated in the internal space of the main body housing 80 is located. The position where the error microphone 89 is provided is the canceling location (or can be considered as the canceling location). The cross-sectional areas of the flow path of the airflow inside the main body housing 80 discontinuously vary (specifically, the flow path suddenly expands) at the discharge port 82. The discontinuous variation in the cross-sectional areas of the flow path causes reflection of the noise at the discharge port 82. The standing wave of the noise is produced due to the reflection.

Basically, the control speaker 88 has the same capacity of that of the control speaker 54 in the first embodiment, and the error microphone 89 has the same capacity of that of the error microphone 55 in the first embodiment. The control speaker 88 and the error microphone 89 are disposed based on the same idea as that for the disposition of the control speaker 54 and the error microphone 55 in the first embodiment.

As illustrated in FIG. 20, the drive unit 90 includes a motor housing 901, a motor 902, and a fan 903.

The motor housing 901 is in contact with the inner wall of the main body housing 80. The motor housing 901 has a cylindrical shape. The motor 902 is disposed almost at the center of the motor housing 901. This arrangement provides a flow path 80*c* between the motor 902 and the motor housing 901. The flow path 80*c* has an annular cross-section.

The motor 902 is driven in accordance with an instruction from the control circuit board 91. The motor 902 in the fourth embodiment is a direct-current motor.

The fan 903 is fixed to the rotor of the motor 902.

The drive unit 90 is situated such that the motor 902 faces the first space 80*a* and the fan 903 faces the second space 80*b* inside the main body housing 80. The drive unit 90 generates airflow inside the main body housing 80. The airflow is directed from the suction port 81 to the discharge port 82. The airflow is generated by rotation of the fan 903 driven by the motor 902.

Generation of the airflow by the drive unit 90 causes external air to be introduced into the internal space of the main body housing 80 through the suction port 81. The introduced external air passes through the first space 80*a*. In the first space 80*a*, the external air passes through the dust bag, leaving grit and dust contained in the external air trapped and collected inside the dust bag. The air that passes through the dust bag flows through the flow path 80*c*, then reaching the second space 80*b*. The air that reaches the second space 80*b* is discharged from the discharge port 82.

[4-3. Control Circuit Board]

The control circuit board 91 is operated in response to power supply from the first battery pack 86A and/or the second battery pack 86B. The control circuit board 91 includes a motor controller 911 and a noise controlling portion 912. The motor controller 911 drives the motor 902 in response to manipulation of the electronic switch 85. The noise controlling portion 912 reduces a target noise. The target noise in the fourth embodiment is the noise generated by operation of the motor 902.

The motor controller 911 includes a configuration that corresponds to the dust collection circuit group 442 and the control circuit 441 illustrated in FIG. 8.

Figure 22:
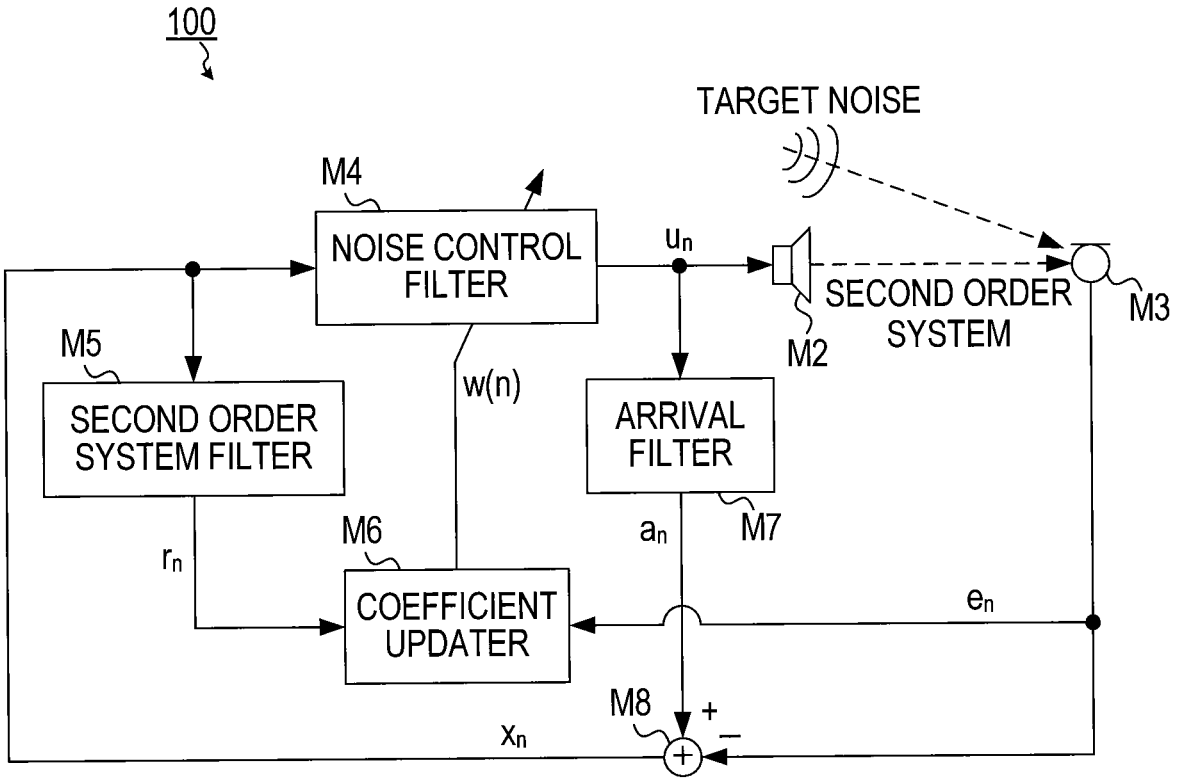
FIG. 22 is a block diagram of a model of a feedback ANC system.

The handheld vacuum cleaner 8 includes a noise controller 100 (see FIG. 22). The noise controller 100 includes the noise controlling portion 912, the control speaker 88, and the error microphone 89.

The noise controlling portion 912 includes a configuration that corresponds to the second A/D converter 445, the D/A converter 446, and the control circuit 441 illustrated in FIG. 8. The noise controlling portion 912, together with the control speaker 88 and the error microphone 89, achieves feedback ANC. In other words, the noise controller 100 reduces the target noise by the feedback ANC as in the noise controller 10 in the first to third embodiments.

[4-4. ANC Model]

Referring now to FIG. 22, a feedback ANC model achieved by the noise controller 100 in the fourth embodiment will be described. The noise controller 100 can be represented by the control model illustrated in FIG. 22. Part of the feedback ANC model in the fourth embodiment is common to the feed-forward ANC model in the first embodiment illustrated in FIG. 9. Thus, the same configurations as in the first embodiment will be given the same reference numerals as in the first embodiment.

In comparison with the feed-forward ANC model, the feedback ANC model includes, as illustrated in FIG. 22, no reference sensor M1 but additionally includes an arrival filter M7 and an adder M8. The control sound source M2 corresponds to the control speaker 88 and the D/A converter 446 (see FIG. 8). The error sensor M3 corresponds to the error microphone 89 and the second A/D converter 445 (see FIG. 8).

The noise controlling portion 912 may include a microcomputer. In this case, the noise control filter M4, the second order system filter M5, the coefficient updater M6, the arrival filter M7, and the adder M8 may be achieved by software processing by the microcomputer, or may be partly or entirely achieved by hardware.

The arrival filter M7 includes the same configuration as that of the second order system filter M5. The arrival filter M7 estimates an artificial noise arrival signal an from N control signals $u_n$ (specifically, N-dimensional control vector u(n)) that are most recently calculated. The artificial noise arrival signal $a_n$ indicates an artificial noise that has arrived at the error sensor M3 from the control sound source M2.

The adder M8 estimates the reference signal $x_n$ indicating the target noise.

Specifically, the adder M8 estimates (specifically, calculates) the reference signal $x_n$ by subtracting the error signal $e_n$ from the artificial noise arrival signal $a_n$.

In other words, the estimated results based on the control signal $u_n$ and the error signal $e_n$ are used as the reference signal $x_n$ in the feedback ANC, in place of the results of the detection by the reference sensor M1.

[4-5. Process]

The process executed by the noise controlling portion 912 is basically the same as the process described in any one of the first to third embodiments.

However, the process of S110 in the noise reduction process (see FIG. 12) is different in the fourth embodiment from the process in the first to third embodiments. Specifically, the artificial noise arrival signal $a_n$ is generated by the arrival filter M7 in S110 in the fourth embodiment. Moreover, the error signal $e_n$ is subtracted from the artificial noise arrival signal $a_n$ to generate the reference signal $x_n$ in S110.

[4-6. Correspondence of Terms]

In the fourth embodiment, the adder M8 corresponds to one example of the adder in the present disclosure.

[4-7. Effects]

According to the fourth embodiment described in detail above, the following effects are achieved in addition to the effects (1a), (1b), and (1c) of the first embodiment, the effects (2a) and (2b) of the second embodiment, and the effects (3a), (3b), and (3c) of the third embodiment.

(4a) In the fourth embodiment, the feedback ANC is used. This allows omission of the reference sensor M1, thereby simplifying the configuration of the noise controller 100.

[5. Other Embodiments]

(5-1) In the first to fourth embodiments, the number of taps L of the noise control filter M4 is set larger than the number of taps N of the second order system filter M5. When a divergence tendency is detected, the taps whose coefficients are updated (enabled taps) are limited to M taps from the highest-order in the noise control filter M4. However, it is only one embodiment of the present disclosure to change the number of enabled taps in the noise control filter M4 from L to M based on detection of a divergence tendency. For example, the number of taps in the noise control filter M4 may be initially fixed to M. In this case, it is possible to omit the process to limit the number of enabled taps based on detection of a divergence tendency. It is also possible in this case to omit the divergence determination process in S140 of the noise reduction process illustrated in FIG. 12.

(5-2) In the first to third embodiments, the signal detected by the reference microphone 53 is used as the reference signal $x_n$ in the process of S110. However, the reference signal $x_n$ is not limited to the signal detected by the reference microphone 53. The reference signal $x_n$ may be any signal that has a correlation with the target noise. The reference signal $x_n$ may be, for example, a signal for driving the motor 432 (for example, a drive signal outputted from the control circuit 441 to the dust collection circuit group 442) or a signal corresponding or related to such a signal.

(5-3) The control speaker 54 and the error microphone 55 in the first to third embodiments are arranged such that they face the same direction and aligned with each other. However, the control speaker 54 and the error microphone 55 may be arranged in any specific manner. For example, the control speaker 54 and the error microphone 55 may be arranged facing each other. The control speaker 88 and the error microphone 89 in the fourth embodiment may also be arranged in any specific manner.

(5-4) In the third embodiment, the block length $J_{BK}$ is constant. However, if fluctuations in the signal power $P_{kc}$ are expected, the block length $J_{BK}$ may be changed. In this case, a control may be performed to, for example, extend the block length $J_{BK}$ until the signal power $P_{kc}$ becomes a constant value.

(5-5) In the first to fourth embodiments, the dust collector 1 and the handheld vacuum cleaner 8 are described as examples of the electric powered work machine with the techniques of the present disclosure. However, the present disclosure may be applied not only to the dust collector 1 and the handheld vacuum cleaner 8, but also to other electric powered work machines. The present disclosure may be applied to, for example, various jobsite electric apparatuses that are used at jobsites, such as do-it-yourself carpentry, manufacturing, gardening, and construction sites, and those that utilize airflow generated with a fan. Specifically, the techniques of the present disclosure may be applied to various electric powered work machines such as machinery for gardening and devices for creating pleasant jobsite environment. More specifically, the present disclosure may be applied to various electric powered work machines such as electric lawn mowers, electric lawn trimmers, electric bush/grass cutters, electric cleaners, electric blowers, electric sprayers, electric spreaders, and electric dust collectors.

(5-6) Functions of one component in the above-described embodiments may be achieved by two or more components, and a function of one component may be achieved by two or more components. Moreover, functions of two or more components may be achieved by one component, and a function achieved by two or more components may be achieved by one component. Some of the components of the above-described embodiments may be omitted. At least part of the configurations of the above-described embodiments may be added to or replaced with other configurations of the above-described embodiments.

What is claimed is:

1. A dust collector comprising:

a main body including a suction port, a discharge port, and a flow path, the flow path extending within the main body from the suction port to the discharge port;

a motor housed in the main body;

a fan housed in the main body, the fan being configured to be driven by the motor to generate an airflow in the flow path; and a noise controller provided in the main body, the noise controller including:

a reference sensor including a reference microphone disposed in a vicinity of the motor, the reference microphone being configured to detect a target noise that corresponds to a noise generated due to operation of the motor, and the reference sensor being configured to generate a reference signal that digitally indicates the target noise detected by the reference microphone;

a noise control filter that is in a form of a digital filter and includes L taps each tap of which has a coefficient, the noise control filter being configured such that the coefficient is adjusted, and the noise control filter being configured to (i) receive the reference signal from the reference sensor and (ii) generate a control signal to cancel or attenuate the target noise;

a control sound source configured to receive the control signal and to produce an artificial noise in accordance with the control signal;

an error sensor including an error microphone disposed in a vicinity of the discharge port, the error microphone being configured to detect a synthesized sound, the synthesized sound corresponding to a combined sound of the artificial noise and the target noise at a given canceling location, and the error sensor being configured to convert the synthesized sound to an error signal that digitally indicates the synthesized sound detected by the error microphone;

a second order system filter that is in a form of a digital filter and includes transfer characteristics of a second order system, the second order system corresponding to a path from the control sound source to the error sensor, the second order system filter including N taps each tap of which has a coefficient, and the second order system filter being configured to (i) receive the reference signal from the reference sensor and (ii) generate a filtered reference signal; and a coefficient updater configured to update the coefficient of each tap of the M taps out of the L taps in accordance with an adaptive algorithm that uses the error signal and the filtered reference signal, the M taps being any number of taps in the L taps, and each of M and N being a positive integer satisfying M<N.

2. An electric powered work machine comprising:

a motor configured to generate a driving force necessary for performing a jobsite work;

a reference acquirer configured to acquire a reference signal that has a correlation with a target noise, the target noise corresponding to a noise generated due to operation of the motor;

a first digital filter including a series of taps each tap of which has an adjustable coefficient, the first digital filter being configured to (i) receive the reference signal from the reference acquirer and (ii) generate a control signal to cancel or attenuate the target noise;

a control sound source configured to produce an artificial noise in accordance with the control signal;

an error sensor configured to convert a synthesized sound at a given canceling location to an error signal, the synthesized sound corresponding to a combined sound of the artificial noise and the target noise at the canceling location;

a second digital filter including transfer characteristics of a second order system, the second order system corresponding to a path from the control sound source to the error sensor, the second digital filter including N taps, the second digital filter being configured to (i) receive the reference signal from the reference acquirer and (ii) generate a filtered reference signal; and a characteristics adjustor configured to adjust the adjustable coefficient of each tap of M taps in the series of taps in accordance with an adaptive algorithm that uses the error signal and the filtered reference signal, the M taps being any number of taps in the series of taps, and each of M and N being a positive integer satisfying $M<N$.

3. The electric powered work machine according to claim 2, wherein the M taps correspond to all taps of the series of taps.

4. The electric powered work machine according to claim 2, further comprising a divergence determiner configured to determine whether the first digital filter indicates a divergence tendency, wherein the characteristics adjustor is configured to:

(i) update the adjustable coefficient of each tap of L taps in the series of taps prior to a determination, by the divergence determiner, that the first digital filter indicates a divergence tendency; and (ii) set the adjustable coefficient of each tap of an $M+1^{th}$ tap and subsequent taps in the series of taps to a given value and update the adjustable coefficient of each tap of $1^{st}$ to $M^{th}$ taps in the series of taps, in response to a determination, by the divergence determiner, that the first digital filter indicates a divergence tendency, wherein the L taps correspond to all taps of the series of taps, and wherein L is a positive integer satisfying $L \geq N$.

5. The electric powered work machine according to claim 4, wherein the given value is a coefficient of a corresponding tap in an imaginary digital filter, the imaginary digital filter including characteristics obtained by multiplying an impulse response of a first order system by characteristics of a reverse filter of the second order system filter, and the first order system corresponding to a path from the motor to the error sensor.

6. The electric powered work machine according to claim 4, wherein the divergence determiner is configured to determine whether the first digital filter indicates a divergence tendency based on an intensity of the error signal and/or a change tendency in the intensity.

7. The electric powered work machine according to claim 4, wherein the divergence determiner is configured to determine whether the first digital filter indicates a divergence tendency based on an output intensity of each tap of the L taps, a magnitude of the adjustable coefficient of each tap of the L taps, and/or a change tendency in a parameter used for updating the adjustable coefficient.

8. The electric powered work machine according to claim 4, wherein the L taps have a length that corresponds to a length of time necessary for an impulse response of a first order system to converge, the first order system corresponding to a path from the motor to the error sensor.

9. The electric powered work machine according to claim 2, wherein the N taps have a length to complete a process necessary for producing the artificial noise, and wherein the process necessary for producing the artificial noise including:

(i) a first process executed by the characteristics adjustor, the first process including updating of the adjustable coefficient by the characteristics adjustor in accordance with the reference signal within a first time period, and the first time period corresponding to a time required from an acquisition of the reference signal by the reference acquirer to a detection of the target noise corresponding to the reference signal by the error sensor; and/or (ii) a second process executed by the first digital filter, the second process including generation of the control signal in accordance with the reference signal by the first digital filter with the adjustable coefficient updated by the first process.

10. The electric powered work machine according to claim 2, wherein the characteristics adjustor is configured to stop updating of the adjustable coefficient in response to the adjustable coefficient being updated a given number of times by the characteristics adjustor.

11. The electric powered work machine according to claim 2, wherein the characteristics adjustor is configured to update the adjustable coefficient based on an update value that corresponds to a value obtained by multiplying an update step size by a gradient vector, the update step size indicating a degree to which the adjustable coefficient is changed, and the gradient vector indicating a direction toward which the adjustable coefficient is changed.

12. The electric powered work machine according to claim 11, wherein the characteristics adjustor is configured to calculate the update value with an average value of the gradient vector that is repeatedly calculated every two or more processing cycles.

13. The electric powered work machine according to claim 11, wherein the characteristics adjustor is configured to vary the update step size in accordance with a converging status of the first digital filter.

14. The electric powered work machine according to claim 2, wherein the reference acquirer includes a reference sensor configured to detect the target noise to thereby generate the reference signal.

15. The electric powered work machine according to claim 14, wherein a distance between the reference sensor and the control sound source is larger than a distance between the control sound source and the error sensor.

16. The electric powered work machine according to claim 2, wherein the electric powered work machine is configured to generate a drive signal for driving the motor, and wherein the reference signal corresponds to the drive signal.

17. The electric powered work machine according to claim 2, wherein the reference acquirer includes:

a third digital filter including characteristics identical to characteristics of the second digital filter, the third digital filter being configured to (i) receive the control signal from the first digital filter and (ii) generate an arrival signal, and the arrival signal indicating the artificial noise that has arrived at the error sensor; and an adder configured to add the arrival signal to the error signal to thereby generate the reference signal.

18. The electric powered work machine according to claim 2, wherein the electric powered work machine includes:

a fan configured to be driven by the motor to generate an airflow;

a flow path configured to allow passage of the airflow generated by the fan; and a discharge port configured to discharge the airflow from the flow path, and wherein the control sound source and the error sensor are arranged such that the discharge port corresponds to the canceling location.

19. The electric powered work machine according to claim 18, wherein the flow path includes an inner wall configured to guide the airflow, wherein at least a part of the inner wall includes a sound absorbing material configured to reduce a sound generated due to a friction between the sound absorbing material and the airflow, and wherein the error sensor is disposed at a position so that the error sensor faces the flow path with the sound absorbing material interposed therebetween.

20. A method of controlling a noise generated by an electric powered work machine, the method comprising:

acquiring a reference signal having a correlation with a target noise, the target noise corresponding to a noise resulting from motor operation in the electric powered work machine;

generating a control signal from the reference signal by a first digital filter, the control signal being used to cancel or attenuate the target noise, the first digital filter including a series of taps, and the first digital filter including adjustable characteristics;

producing an artificial noise by a control sound source in accordance with the control signal;

converting a synthesized sound at a canceling location to an error signal by an error sensor, the canceling location being a given position, and the synthesized sound corresponding to a combined sound of the artificial noise and the target noise;

generating a filtered reference signal from the reference signal by a second digital filter including transfer characteristics of a second order system, the second order system corresponding to a path from the control sound source to the error sensor, and the second digital filter including N taps; and updating coefficients of M taps in the series of taps in accordance with an adaptive algorithm, the adaptive algorithm using the error signal and the filtered reference signal, the M taps being any number of taps in the series of taps, and each of M and N being a positive integer satisfying $M<N$.

* * * * *